US006824869B2

(12) United States Patent
Koyanagi et al.

(10) Patent No.: US 6,824,869 B2
(45) Date of Patent: Nov. 30, 2004

(54) POLYESTER TYPE CONJUGATE FIBER PACKAGE

(75) Inventors: Tadashi Koyanagi, Nobeoka (JP); Takao Abe, Nobeoka (JP)

(73) Assignee: Asahi Kasei Fibers Corporation, Osaka (JP)

( * ) Notice: Subject to any disclaimer, the term of this patent is extended or adjusted under 35 U.S.C. 154(b) by 0 days.

(21) Appl. No.: 10/286,894

(22) Filed: Nov. 4, 2002

(65) Prior Publication Data

US 2003/0143395 A1 Jul. 31, 2003

(30) Foreign Application Priority Data

Nov. 6, 2001 (JP) ..... 2001-340286
Dec. 26, 2001 (JP) ..... 2001-393491

(51) Int. Cl.[7] ..... D01F 6/00
(52) U.S. Cl. ..... 428/364; 428/395; 206/392
(58) Field of Search ..... 206/392; 428/364, 428/395

(56) References Cited

U.S. PATENT DOCUMENTS

| | | | | |
|---|---|---|---|---|
| 3,671,379 A | | 6/1972 | Evans et al. | 161/173 |
| 6,306,499 B1 | | 10/2001 | Ochi et al. | 428/364 |
| 6,673,443 B2 | * | 1/2004 | Koyanagi et al. | 428/364 |
| 2002/0025433 A1 | | 2/2002 | Chang et al. | 428/370 |

FOREIGN PATENT DOCUMENTS

| | | |
|---|---|---|
| EP | 1 059 372 A2 | 12/2000 |
| GB | 965729 | 8/1964 |
| JP | 05295629 A | 11/1993 |
| JP | 05306069 A | 11/1993 |
| JP | 6-25262 | 5/1994 |
| JP | 11189923 A | 7/1999 |
| JP | 11269721 A | 10/1999 |
| JP | 2000128428 A | 5/2000 |
| JP | 2000239927 A | 5/2000 |
| JP | 2000239927 A | 9/2000 |
| JP | 2000256918 A | 9/2000 |
| JP | 2000335824 A | 12/2000 |
| JP | 2001020136 A | 1/2001 |
| JP | 2001055634 A | 2/2001 |
| JP | 2001131837 A | 5/2001 |
| JP | 2001214372 A | 8/2001 |
| JP | 2001288621 A | 10/2001 |
| JP | 2001348734 A | 12/2001 |
| JP | 2001355131 a | 12/2001 |
| JP | 2002054029 A | 2/2002 |
| JP | 2002061031 A | 2/2002 |
| JP | 2002088570 A | 3/2002 |
| JP | 2002088586 A | 3/2002 |
| JP | 2002-339169 | 11/2002 |
| WO | WO 01/53573 A1 | 7/2001 |
| WO | WO 01/85590 A1 | 11/2001 |
| WO | WO 02/04332 A1 | 1/2002 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

A package of polyester type conjugate fiber of either a side-by-side type or an eccentric sheath/core type in which two kinds of polyester components are adhered to each other to form a single filament, wherein at least one of the components consisting of the single filament is polytrimethylene terephthalate containing repeating units of trimethylene terephthalate of 90 mol % or more, which package is formed of 2 kg or more of the conjugate fiber and satisfies the following items (1) to (3): (1) the difference in diameter between a selvage portion and a central portion of the package is 10 mm or less, (2) a winding width of the package is in a range from 60 to 250 mm and a diameter of the package is in a range from 100 to 400 mm, and (3) the difference in dry-heat shrinkage stress value between the conjugate fibers layered in the selvage portion and the central portion of the package is 0.05 cN/dtex or less.

11 Claims, 10 Drawing Sheets

POLYESTER TYPE CONJUGATE FIBER PACKAGE

TECHNICAL FIELD

The present invention relates to a polyester type conjugate fiber package obtained by a single-stage melt-spinning method, a method for producing the same and a false-twist texturing method thereof.

BACKGROUND ART

Polyethylene terephthalate (hereinafter referred to as PET) fiber has been mass-produced throughout the world, to establish a large industry, because it is most suitable for the clothing use.

Polytrimethylene terephthalate (hereinafter referred to as PTT) fiber is known from prior art documents such as J. Polymer Science: Polymer Physics Edition: Vol. 14, p 263 to 274 (1976), Japanese Unexamined Patent Publication (Kokai) No. 52-5320 or WO-99/27168.

There is a disclosure in these prior art documents in that a fabric using PTT fibers having a proper elongation at break, thermal stress and/or shrinkage in boiling water has a low modulus to exhibit a soft hand touch and is suitable for the clothing such as inner wear, outer wear, sportswear, hosiery, lining cloth or swim suits.

On the other hand, polyester conjugate fibers of a side-by-side type or an eccentric sheath/core type have been known as fibers capable of providing a fabric with a bulkiness without being subjected to a false-twist texturing process.

As a PTT type conjugate fiber characterized by a soft hand touch, there is a conjugate fiber in which PTT is used as at least one of its components or a conjugate fiber in which PTTs having different inherent viscosities are used as both components (hereinafter, these are referred to as polyester type conjugate fibers), as disclosed in Japanese Examined Patent Publication (Kokoku) No. 43-19108, Japanese Unexamined Patent Publication (Kokai) Nos. 11-189923, 2000-239927, 2001-55634, EP 1059372, Japanese Unexamined Patent Publication No. 2001-131837, U.S. Pat. No. 6,306,499, WO 01/53573 or US 2002-0025433. These prior art documents describe that the polyester type conjugate fiber is characterized by a soft hand touch and a favorable crimp developing property which characteristics are suitable for various stretch fabrics or bulky fabrics.

In general, when the polyester type conjugate fiber is produced by a melt spinning method, there are a two-stage method in which an undrawn fiber once wound as a package is drawn to be a drawn fiber and a single-stage method in which the spinning and the drawing are continuously carried out in one process.

In Japanese Unexamined Patent Publication (Kokai) Nos. 2001-131837, 2001-348734 and 2002-61031, a so-called direct spin-draw method is proposed when the polyester type conjugate fiber is produced, in which the spinning and the drawing are continuously carried out in one stage.

Particularly, in Japanese Unexamined Patent Publication No. 2001-131837, a polyester type drawn conjugate fiber is disclosed, which has a stretching elongation of 10% or more even under a load of $3.5\times10^{-3}$ cN/dtex by controlling a thermal shrinkage stress thereof to be 0.25 cN/dtex or more. This polyester type drawn conjugate fiber can be hard-twisted and used for a woven fabric having a large structural-constraint force, in which fabric the fiber develops a high crimpability.

Methods for obtaining a pre-oriented fiber to be false-twisted are disclosed in Chemical Fibers International: Vol. 47. p72 to 74 (February, 1997), and Japanese Unexamined Patent Publication (Kokai) Nos. 2001-20136 and 2000-256918. In these documents, as a pre-oriented fiber to be false-twisted, a fiber consisting solely of PTT or a polyester type conjugate fiber is disclosed, which is wound at a speed of 2000 to 6000 m/min without using a godet roll or with a cold godet roll.

According to the study of the present inventors, the polyester type pre-oriented conjugate fiber or drawn conjugate fiber obtained at a high spinning speed has a high orientation degree but a low crystallinity. Such a pre-oriented conjugate fiber or drawn conjugate fiber has a glass transition temperature in a range from approximately 35 to 45° C. and is extremely sensitive to temperature and humidity.

In a spinning process, there is a phenomenon in that the heat generation of a motor of a winder running at a high speed is transmitted to a package via a bobbin shaft to increase the package temperature. Also, the package temperature rises by the heat generated due to the friction between the package and a presser roll. It has been also apparent that, if the package temperature is increased by such causes, the pre-oriented conjugate fiber or drawn conjugate fiber shrinks in the package during the winding.

The shrinkage of the pre-oriented conjugate fiber or drawn conjugate fiber hardly occurs in package-selvage portions (hereinafter referred merely to as selvage portions) in which the fiber is layered to have a high winding hardness, but solely occurs in the fiber layered in the remaining portion (hereinafter referred to as a central portion). As a result, the package is of a high-selvage shape during the winding. Once the high-selvage shape is formed, the selvage portion is alone in contact with the presser roll and the frictional heat is further concentrated to the selvage portion as a winding weight of the package increases.

The resultant package thus wound to have a predetermined diameter is of a so-called high-selvage shape wherein a (winding) diameter of the selvage portion is larger than that of the central portion. FIG. 1 is a schematic illustration of a package in a non-high-selvage shape, and FIG. 2 is a schematic illustration of a package in a high-selvage shape.

The high-selvage shaped package not only has a difference in diameter but also has a large difference in fiber property as described later, such as a thermal characteristic, yarn fineness and the number of crimps, between the selvage portion and the central portion.

In addition, as a winding weight increases, a lateral end surface of the package tends to be bulged outward due to the fiber shrinkage to form a so-called bulge whereby it is impossible to remove the package from the winder.

(i) Difference in Dry Heat Shrinkage Stress Value

The polyester type conjugate fibers in the selvage portion and the central portion of the package are different from each other in dry shrinkage stress value obtained by the measurement of the heat shrinkage stress described later. That is, the dry heat shrinkage stress value of the conjugate fiber in the selvage portion is higher than that of the conjugate fiber in the central portion.

It has been apparent that the difference in heat shrinkage characteristic becomes apparent as a difference in shrinkage or crimpability of a fabric during the dyeing process to cause a drawback of appearance quality such as a tight yarn or a puckering.

(ii) Variation in Yarn Fineness

The variation in yarn fineness of the pre-oriented conjugate fiber or drawn conjugate fiber is a periodic variation corresponding to a fiber length from one of the selvage portions of the package to the other (1 stroke or 2 strokes).

Charts measuring the variation in yarn fineness of the pre-oriented conjugate fiber or drawn conjugate fiber unwound from the package by an evenness tester are shown in FIGS. 3 and 4. FIG. 3 is a chart corresponding to the package of FIG. 1 and FIG. 4 is a chart corresponding to the package of FIG. 2. In the measurement charts, the periodic variation is observed by downward pin-like signals appearing at an equal pitch on a lower yarn fineness side. The existence of the downward signal means that a yarn fineness of the fiber (yarn thickness) at this point in the fiber length direction fluctuates to the smaller side.

It has been apparent that such a variation in yarn fineness causes a periodic dyeing unevenness in a false-twist textured yarn or a fabric.

(iii) Apparent Crimp

The polyester type conjugate fiber is characterized to have a latent crimpability capable of developing the crimp after the heat treatment. However, there may be a case in which the crimp has already been developed while the fiber is maintained as being wound in the package. This is the apparent crimp.

As the apparent crimp can cause a rise in the unwinding tension when the polyester conjugate fiber is unwound from the package at a high speed, it is preferably lowered.

As described before, it has been apparent that the polyester type conjugate fiber wound in the selvage portion of the package is liable to develop the apparent crimp in comparison with the fiber wound in the central portion.

For instance, there may be a case in which the apparent crimp exists in the selvage portion even if no apparent crimp exists in the central portion. When the polyester type conjugate fiber is unwound from such a package at a high speed, it has been apparent that the unwinding tension fluctuates due to apparent crimp to generate the yarn breakage during the false-twist texturing process or the weaving/knitting process.

(iv) High-speed Unwinding Property

A plain weave fabric represented by taffeta or twill or a warp knit fabric such as a tricot fabric is adopted for the clothing such as a lining cloth or a innerwear. Since a raw fiber not processed by a false-twist texturing or the like is often used for these fabrics, the arrangement of the fibers in the fabric is regular. Thus, there is a problem in that the drawback existing in the fiber is directly apparent as a fault in the fabric such as a streaky warp, a tight weft or a dyeing unevenness.

Recently, a cost competition has become severe in the weaving or knitting process and the processing speed has been higher in correspondence thereto. For example, a warping speed in the preparation of warp yarns for the woven fabric increases from the conventional range of from 100 to 200 m/min to a recent range of from 500 to 1000 m/min. Also, a weft-picking speed in the loom is as fast as in a range from 800 to 1500 m/min in an industrial process.

If the fluctuation of the unwinding tension corresponding to the yarn length from one end surface to the other end surface of the package is large during the unwinding of the polyester type conjugate fiber from the package at a high speed, the yarn breakage increases. Also, if the difference between the maximum value and the minimum value of the tension fluctuation (hereinafter referred to as the difference in unwinding tension) is large, a periodic quality fault occurs in the fabric, such as a tight yarn or others.

FIG. 7 is a chart showing a fluctuation of the the unwinding tension when the polyester type conjugate fiber is unwound at a high speed from the package having a favorable winding shape shown in FIG. 1. FIG. 8 is a chart showing a fluctuation of the unwinding tension when the polyester type conjugate fiber is unwound at a high speed from the package having an unfavorable winding shape shown in FIG. 2.

In FIGS. 7 and 8, a horizontal axis represents a yarn length of the polyester type conjugate fiber and a vertical axis represents an unwinding tension.

Accordingly, in any case when the polyester type conjugate fiber package having the above-mentioned drawbacks therein is used for the knitting or the weaving as it is without being drawn or when it is used for the knitting or the weaving after being drawn and false-twisted, the resultant dyed fabric generally is unfavorable in dyeing uniformity and exhibits a periodic unevenness of dyeing or luster. Thus, it has been apparent that the economical value of the fabric which is a final product is significantly deteriorated. Such a drawback cannot be solved even though the high-selvage shape of the package is eliminated to some extent.

Either of the packages disclosed in Japanese Unexamined Patent Publication (Kokai) Nos. 2001-131837 and 2001-348734 have the above-mentioned periodic drawbacks therein because the heat shrinkage of the conjugate fiber is large and the high-selvage shape is significant during the winding process.

Accordingly, there has been no polyester type conjugate fiber, obtained by the single-stage melt-spinning method in the prior art, which is capable of producing a fabric free from periodic dyeing unevenness, good in dyeing uniformity and excellent in dignity as well as no polyester type conjugate fiber package excellent in high-speed unwinding capability.

DISCLOSURE OF THE INVENTION

An object of the present invention is to provide a polyester type conjugate fiber package obtained by a single-stage melt-spinning method and suitable for the clothing use. The polyester type conjugate fiber obtained by the present invention is smoothly unwound from the package at a high speed and provided to the knitting/weaving process as it is without being drawn, or it is provided to the knitting/weaving process after being false-twisted or draw-textured. The resultant fabric is free from periodic dyeing unevenness and excellent in dyeing uniformity as well as stretchability and stretch-back property.

Another object of the present invention is to provide a method for false-twisting a polyester type pre-oriented conjugate fiber.

The problems to be solved by the present invention are to eliminate the prior art drawbacks in the polyester type conjugate fiber package obtained by the single-stage melt-spinning method, such as the tension fluctuation during the high speed unwinding, the heat shrinkage characteristic, the yarn fineness variation characteristic and the crimp characteristic resulting from the high-selvage shape of the package as well as the periodic dyeing unevenness in the yarn length direction.

The present inventors have diligently studied to solve the above problems and found that they can be solved by specifying the spinning conditions and the winding conditions of the polyester type conjugate fiber when it is spun and wound with or without being drawn.

That is, the present inventors have found that it is possible to eliminate various drawbacks generated in the selvage portion of the polyester type conjugate fiber package during the winding thereof by specifying an extruding conditions and a spinning tension during the spinning process, a temperature and a winding speed of the package during the winding thereof in the production of the conjugate fiber. The polyester type conjugate fiber package obtained by the above method has the specific range of the heat shrinkage characteristic and the yarn fineness variation characteristic both in the selvage portion and the central portion, whereby it is excellent in high-speed unwinding property. The resultant polyester type conjugate fiber can be provided to the knitting/weaving process as it is without being drawn or after being draw-textured. The obtained fabric is free from the periodic dyeing unevenness and excellent in dyeing uniformity as well as in stretchability and stretch-back property.

The present invention is as follows:

1. A package of polyester type conjugate fiber of either a side-by-side type or an eccentric sheath/core type in which two kinds of polyester components are adhered to each other to form a single filament, wherein at least one of the components consisting of the single filament is polytrimethylene terephthalate containing repeating units of trimethylene terephthalate of 90 mol % or more, which package is formed of 2 kg or more of the conjugate fiber and satisfies the following items (1) to (3):

(1) the difference in diameter between a selvage portion and a central portion of the package is 10 mm or less, (2) a winding width of the package is in a range from 60 to 250 mm and a diameter of the package is in a range from 100 to 400 mm, and (3) the difference in dry-heat shrinkage stress value between the conjugate fibers layered in the selvage portion and the central portion of the package is 0.05 cN/dtex or less.

2. A package of polyester type conjugate fiber as defined by the above 1, wherein the difference in dry-heat shrinkage stress value between the conjugate fibers layered in the selvage portion and the central portion of the package is 0.01 cN/dtex or less.

3. A package of polyester type conjugate fiber as defined by the above 1 or 2, wherein the conjugate fiber layered in the package is a pre-oriented conjugate fiber having an elongation at break in a range from 60 to 120%.

4. A package of polyester type conjugate fiber as defined by the above 1 or 2, wherein the conjugate fiber layered in the package is a drawn conjugate fiber having an elongation at break in a range from 25 to 80%.

5. A package of polyester type conjugate fiber as defined by any one of the above 1 to 4, wherein a yarn fineness variation value U % of the conjugate fiber unwound from the package is 1.5% or less and a variation coefficient of a yarn fineness variation period is 0.4 or less.

6. A package of polyester type conjugate fiber as defined by any one of the above 1 to 5, wherein the relationship between the difference ΔF (cN/dtex) in unwinding tension during the unwinding of the conjugate fiber from the package and an unwinding speed u (m/min) satisfies the following formula (1):

$$\Delta F \leqq 8.0\times10^{-6}u \quad (1)$$

7. A package of polyester type conjugate fiber as defined by any one of the above 1 to 6, wherein a bulge percentage of the package is 12% or less.

8. A package of polyester type conjugate fiber as defined by any one of claims 1 to 7, wherein a stretching elongation Vc of the conjugate fiber layered in the selvage portion of the package is 20% or less prior to being treated with boiling water.

9. A package of polyester type conjugate fiber as defined by any one of the above 1 to 8, wherein a hardness of the selvage portion of the package is in a range from 50 to 90 and the difference in hardness between the opposite selvage portions is 10 or less.

10. A package of polyester type conjugate fiber as defined by any one of the above 1 to 9, wherein a density of the package is in a range from 0.80 to 0.92 g/cm$^3$.

11. A package of polyester type conjugate fiber as defined by any one of the above 1 to 10, wherein either of the two kinds of polyester components is polytrimethylene terephthalate containing 90 mol % or more of the repeating units of trimethylene terephthalate.

12. Polyester type pre-oriented conjugate fiber of either a side-by-side type or an eccentric sheath/core type in which two kinds of polyester components are adhered to each other to form a single filament, wherein at least one of the components consisting of the single filament is polytrimethylene terephthalate containing repeating units of trimethylene terephthalate of 90 mol % or more, and wherein the pre-oriented conjugate fiber is wound to form a package and satisfies the following items (1) to (4):

(1) a stretching elongation Vc prior to being treated with boiling water is less than 20%, (2) an elongation at break is in a range from 60 to 120%, (3) a dry heat shrinkage stress value is in a range from 0.01 to 0.15 cN/dtex, and (4) a yarn fineness variation value U % is 1.5% or less and a variation coefficient of a yarn fineness variation period is 0.4 or less.

13. Polyester type drawn conjugate fiber of either a side-by-side type or an eccentric sheath/core type in which two kinds of polyester components are adhered to each other to form a single filament, wherein at least one of the components consisting of the single filament is polytrimethylene terephthalate containing repeating units of trimethylene terephthalate of 90 mol % or more, and wherein the drawn conjugate fiber is wound to form a package and satisfies the following items (5) to (8):

(5) a stretching elongation $CE_2$ measured after the conjugate fiber has been treated with boiling water under a load of $2\times10^{-3}$ cN/dtex is in a range from 5 to 100%, (6) an elongation at break is in a range from 25 to 80%, (7) a dry heat shrinkage stress value is in a range from 0.02 to 0.24 cN/dtex, and (8) a yarn fineness variation value U % is 1.5% or less and a variation coefficient of a yarn fineness variation period is 0.4 or less.

14. Polyester type conjugate fiber as defined by the above 12 or 13, wherein a fiber-fiber dynamic friction coefficient of the conjugate fiber is in a range from 0.20 to 0.35 and the difference between maximum and minimum values of the dynamic frictional coefficient in the yarn length direction is 0.05 or less.

15. Polyester type conjugate fiber as defined by any one of the above 12 to 14, wherein the difference in the yarn length direction between maximum and minimum values of a stress value at 10% elongation in the measurement of stress and strain is 0.30 cN/dtex or less.

16. Polyester type conjugate fiber as defined by any one of the above 12 to 15, wherein a degree of modified cross-section of the conjugate fiber is in a range from 1 to 5.

17. False-twist textured yarn of polyester type conjugate fiber obtained by the false-twist texturing of the polyester type conjugate fiber defined by any one of the above 1 to 16, satisfying the following items (a) and (b):

(a) a tensile strength is in a range from 2 to 4 cN/dtex, and (b) a stretching elongation $CE_2$ measured after being treated with boiling water under a load of $2\times10^{-3}$ cN/dtex is in a range from 50 to 250%.

18. A method for producing a package of polyester type conjugate fiber of either a side-by-side type or an eccentric sheath/core type in which two kinds of polyester components are adhered to each other to form a single filament; at least one of the components consisting of the single filament being polytrimethylene terephthalate containing repeating units of trimethylene terephthalate of 90 mol % or more; and the conjugate fiber being spun by a melt-spinning method and wound in the package while being cooled and solidified by a cooling air, wherein a spinning process is carried out by maintaining a spinning tension at 0.3 cN/dtex or less, a package temperature at 30° C. or lower and a winding speed in a range from 1500 to 4000 m/min.

19. A method for producing a package of polyester type pre-oriented conjugate fiber of either a side-by-side type or an eccentric sheath/core type in which two kinds of polyester components are adhered to each other to form a single filament; at least one of the components consisting of the single filament being polytrimethylene terephthalate containing repeating units of trimethylene terephthalate of 90 mol % or more; and the conjugate fiber being spun by a melt-spinning method and wound in the package without drawing the conjugate fiber after being cooled and solidified by a cooling air, wherein the winding is carried out under the condition satisfying the following items (a) to (e):

(a) a spinneret is used to ensure the spinning condition after the two kinds of polyester components join together, having a dimensional ratio L/D of 2 or more wherein L is a hole length and D is a hole diameter and an orifice slanted at an angle from 10 to 40 degrees relative to the vertical direction, (b) the spinning tension is in a range from 0.10 to 0.30 cN/dtex, (c) the heat treatment temperature is in a range from 70 to 120° C. and the heat treatment tension is in a range from 0.02 to 0.10 cN/dtex, (d) the package temperature is 30° C. or lower when the conjugate fiber is wound onto the winder, and (e) the winding speed is in a range from 1,500 to 4,000 m/min.

20. A method for producing a package of polyester type drawn conjugate fiber of either a side-by-side type or an eccentric sheath/core type in which two kinds of polyester components are adhered to each other to form a single filament; at least one of the components consisting of the single filament being polytrimethylene terephthalate containing repeating units of trimethylene terephthalate of 90 mol % or more; and the conjugate fiber being spun by a melt-spinning method and wound in the package as drawn conjugate fiber obtained by directly drawing the conjugate fiber without being once wound in the package after being cooled and solidified by cooling air, wherein the winding is carried out under the condition satisfying the following items (a) and (f) to (h):

(a) a spinneret is used to ensure the spinning condition after the two kinds of polyester components join together, having a dimensional ratio L/D of 2 or more wherein L is a hole length and D is a hole diameter and an orifice slanted at an angle from 10 to 40 degrees relative to the vertical direction, (f) the drawing tension is in a range from 0.05 to 0.40 cN/dtex, (g) a speed $V_R$ of a heated second godet roll is in a range from 2000 to 4000 m/min, (h) a ratio $V_W/V_R$ of a winding speed $V_W$ (m/min) to the speed $V_R$ (m/min) of the heated second godet roll satisfies the following formula (2):

$$0.85 \leqq V_W/V_R \leqq 1 \quad (2)$$

and (i) the package temperature, when the conjugate fiber is wound onto the winder, is 30° C. or lower.

21. A method for producing a package of polyester type conjugate fiber as defined by the above 20, wherein a heat treatment under tension is carried out between a heated second godet roll and a heated third godet roll.

22. A method for producing a package of polyester type conjugate fiber as defined by any one of the above 18 to 21, wherein a traverse angle of the package is changed from the beginning to the completion of the package formation in a range from 3 to 10 degrees in correspondence to the winding diameter of the package.

23. A method for false-twist texturing polyester type pre-oriented conjugate fiber of either a side-by-side type or an eccentric sheath/core type in which two kinds of polyester components are adhered to each other to form a single filament; at least one of the components consisting of the single filament being polytrimethylene terephthalate containing repeating units of trimethylene terephthalate of 90 mol % or more; and the conjugate fiber being spun by a melt-spinning method and wound in the package as pre-oriented conjugate fiber obtained without being drawn after being cooled and solidified by a cooling air, wherein the spinning tension is controlled to 0.30 cN/dtex or less and the package temperature during the winding is maintained at 30° C. or lower, and the draw false-twist texturing or the false-twist texturing is carried by maintaining the temperature of the pre-oriented conjugate fiber at 30° C. not only during the winding process but also during the storage period as well as the false-twist texturing process thereof.

In this regard, the conjugate fiber referred to in the present invention includes a pre-oriented conjugate fiber which is wound without being drawn after the melt-spinning process and a drawn conjugate fiber which is wound after being continuously spun and drawn (by a so-called direct spin-draw method).

The present invention will be described in more detail below.

The polyester type conjugate fiber package according to the present invention is formed of a group of single filaments in which two kinds of polyester components are adhered to each other in the single filament in a side-by-side manner or an eccentric sheath/core manner wherein at least one component constituting the single filament consists solely of PTT.

The two kinds of polyester components may be adhered to each other in a side-by-side manner along the yarn length direction or may be of an eccentric sheath/core type in which one of the polyester components is partially or totally embedded in the other polyester component so that both the components are arranged in an eccentric manner in the fiber cross-section. The side-by-side type is preferable.

If PTT is used as one component, the crimp development in conjugate fiber or false-twist textured yarn becomes favorable. While there is no limitation in the other component, it is preferably selected from polyethylene terephthalate (PET), polytrimethylene terephthalate (PTT) and polybutylene terephthalate (PBT) in view of the adhesivity with PTT. It is most preferable that both of the two kinds of polyester components are PTT.

The difference in intrinsic viscosity between the two kinds of polyester components is preferably in a range from 0.05 to 0.8 dl/g. When the difference of the intrinsic viscosity is within this range, the crimp development becomes sufficient and yarn bending directly beneath the spinneret is less to minimize the yarn breakage.

When the two kinds of polyester components are PTT, respectively, the difference in intrinsic viscosity is preferably in a range from 0.1 to 0.4 dl/g, more preferably from 0.1 to 0.25 dl/g. An average intrinsic viscosity of the conjugate fiber consisting of PTT is preferably in a range from 0.7 to 1.2 dl/g, more preferably from 0.8 to 1.1 dl/g. If the average intrinsic viscosity is in the above-mentioned range, the strength of the conjugate fiber becomes approximately 2 cN/dtex or more to be applicable to a sportswear field requiring the strength.

In the present invention, a ratio of the two kinds of polyester components in the cross-section of the single filament is preferably in a range from 40/60 to 70/30, more preferably from 45/55 to 65/35 wherein the denominator is a component having a lower intrinsic viscosity and the numerator is a component having a higher intrinsic viscosity. If the ratio is within the above range, the crimp performance is facilitated and a strength of the conjugate fiber is as high as 2.5 cN/dtex or more, which is suitable for sportswear use.

The PTT polymer constituting at least one of the components of the polyester type conjugate fiber according to the present invention contains trimethylene terephthalate repeating units of 90 mol % or more and other ester repeating units of 10 mol % or less.

That is, at least one of the components of the polyester type conjugate fiber according to the present invention is a PTT homopolymer or a PTT copolymer containing 10 mol % or less of other ester repeating units as a copolymeric component.

Examples of the copolymeric component are as follows:

As an acidic component, there are aromatic dicarboxylic acid represented by isophthalic acid or 5-sodiumsulfoisophthalic acid and aliphatic dicarboxylic acid represented by adipic acid or itaconic acid. As a glycolic component, there are ethylene glycol, butylene glycol and polyethylene glycol. Also, hydroxy-carboxylic acid such as hydroxybenzoic acid is an example thereof. A plurality of them may be copolymerized.

A trifunctional cross-linking component, such as trimellitic acid, penthaerythritol or pyromellitic acid, is preferably avoided, in some cases, as a copolymerized component because it disturbs the spinning stability or makes the elongation at break of the false-twist textured yarn lower, resulting in the increase in yarn breakage during the false-twist texturing process.

Known methods may be used for the production of the PTT polymer in the present invention. For example, there are a single-stage method wherein the polymerization degree corresponding to a predetermined intrinsic viscosity is obtained only by the melt-polymerization, and a two-stage method wherein the melt-polymerization is used until a certain intrinsic viscosity is achieved and then the solid-state polymerization is used to increase the polymerization degree to a value corresponding to a predetermined intrinsic viscosity.

The latter two-stage method combined with the solid-state polymerization is preferable because it can reduce the content of cyclic dimer in the polymer. When the predetermined intrinsic viscosity is achieved by the single-stage method, the cyclic dimer in the polymer is preferably reduced prior to being supplied to the spinning process by the extraction treatment or others.

The content of trimetylene terephthalate cyclic dimer in the PTT polymer used for the present invention is preferably 2.5 wt % or less, more preferably 1.1 wt % or less, furthermore preferably 1.0 wt % of less.

Also, additives may be mixed or copolymerized with the PTT polymer within a range not disturbing the effect of the present invention, such as titanium oxide as delusterant, heat stabilizer, anti-oxidant, antistatic agent, ultraviolet absorber, anti-fungus agent or various pigments.

The polyester type conjugate fiber package according to the present invention has a winding weight of 2 kg or more. If the winding weight is less than 2 kg, it is necessary to frequently exchange the packages during the false-twist texturing process or the knitting/weaving process, which is economically disadvantageous because work increases and the operating cost rises. The winding weight is preferably approximately 3 kg or more, more preferably approximately 4 kg or more. The upper limit of the winding weight will be approximately 20 kg in view of the manual handling by the operator although it is not particularly restricted, The polyester type conjugate fiber package according to the present invention has the difference in winding diameter in a range from 0 to 10 mm between the selvage portion and the central portion of the package. The difference in winding diameter between the selvage portion and the central portion of the package is an index representing a degree of a so-called high-selvage shape. If the winding diameter is smaller than approximately 100 mm, the difference in winding diameter is insignificant. However, if the winding diameter exceeds approximately 200 mm, the difference in winding diameter increases.

When the difference in winding diameter exceeds 10 mm, the yarn fineness variation period becomes significant in a measurement of the yarn fineness variation explained later. If the yarn fineness variation period becomes significant, a periodic dyeing unevenness occurs in the resultant fabric. To prevent the periodic dyeing unevenness from occurring in the fabric, the difference in winding diameter is more preferably 5 mm or less, furthermore preferably 3 mm or less.

The polyester type conjugate fiber package according to the present invention has a winding diameter of 100 mm or more, preferably in a range from 150 to 400 mm. If the winding diameter is 100 mm or more, the winding weight becomes 2 kg or more to provide a package suitable for the industrial use. If the winding diameter is less than 100 mm, the winding weight becomes insufficient to raise the cost of the polyester type conjugate fiber when the price of a paper tube or a bobbin for the package is added thereto. Also, there is an industrial disadvantage in that a wrapping material, a packing cost and a transportation cost for the package become comparatively high.

A winding width of the polyester type conjugate fiber package is in a range from 60 to 250 mm, preferably from 80 to 200 mm. If the winding width is less than 60 mm, the winding diameter must be excessively large to obtain the winding weight of 2 kg or more, resulting in the difficulty of industrial handling thereof. When the winding width is small, a ratio of the selvage portion to the winding width becomes high to cause the high-selvage shaped package.

Contrarily, if the winding width exceeds 250 mm, the fluctuation of unwinding tension becomes large during the unwinding of the conjugate fiber from the package even though the high-selvage shape is corrected to be as small as possible, resulting in the periodic dyeing unevenness in the resultant fabric and the yarn breakage during the unwinding of the fiber at a high speed.

The dry heat shrinkage stress of the polyester type conjugate fiber is a shrinking force of the fiber due to heat and measured by a method described later. The polyester type conjugate fiber layered in the selvage portion of the package is liable to have the dry heat shrinkage stress value higher than that of the fiber layered in the central portion of the package.

In the present invention, it is important that the difference in the dry heat shrinkage stress value between fibers layered in the selvage portion and in the central portion is 0.05 cN/dtex or less. If the difference in the dry heat shrinkage stress value exceeds 0.05 cN/dtex, the resultant fabric has the abnormality in the fiber layered in the selvage portion, such as a periodic tight yarn or dyeing unevenness to deteriorate the appearance quality of the resultant fabric. This difference in the dry heat shrinkage stress value is preferable as small as possible, and is preferably 0.01 cN/dtex or less, more preferably 0.005 cN/dtex or less. If there is no difference, it is in the most favorable state.

The preferable aspect of the polyester type conjugate fiber according to the present invention will be described below.

(Variation of Yarn Fineness)

Preferably, in the present invention, the yarn fineness variation value U % of the conjugate fiber unwound from the package is 1.5% or less and the variation coefficient of the yarn fineness variation period is 0.4 or less.

If the yarn fineness variation value U % is 1.5% or less, a fabric excellent in uniformity of dyeing is obtained. The yarn fineness variation value U % is preferably 1.2% or less, more preferably 1.0% or less.

If the variation coefficient is 0.4 or less, a fabric excellent in appearance quality is obtainable. The variation coefficient is preferably as small as possible. Particularly, 0.2% or less is favorable.

When the variation coefficient of the yarn fineness variation period exceeds 0.4 even if the yarn fineness variation value U % is 1.5% or less, the dyeing abnormality occurs in the resultant fabric caused by the selvage portion of the polyester type conjugate fiber package, whereby the fabric having a favorable appearance quality may not be obtainable. For example, a woven fabric having a dense structure of warp and weft yarns is liable to have the above-mentioned dyeing abnormality. Particularly, such an abnormality frequently occurs when the pre-oriented fiber is used as it is for the knitting/weaving process, without being subjected to the draw false-twist texturing process.

As described later, the variation coefficient is determined by the periodic analysis of the yarn fineness variation accompanied with the measurement of the yarn fineness variation.

FIG. 5 is a chart of the periodic analysis of the yarn fineness variation in correspondence to FIG. 3, and FIG. 6 is a chart of the periodic analysis of the yarn fineness variation in correspondence to FIG. 4. In these analysis charts, the horizontal axis represents a periodic length, and the vertical axis represents a frequency (variation coefficient).

In the periodic analysis of the yarn fineness variation, the periodic length corresponds to a yarn length measured from one selvage to the other of the polyester type conjugate fiber package. While the yarn length may vary in accordance with a traverse width when the package is formed, it is generally approximately in a range from 0.5 to 10 m. Signals caused by the yarn fineness variation in the selvage portion appear as specific peaks of the variation coefficient at a constant periodic length as shown in FIG. 6.

(Fluctuation of Unwinding Tension)

The polyester type conjugate fiber package according to the present invention preferably satisfies the following formula which defines the relationship between the difference ΔF (cN/dtex) in the unwinding tension and the unwinding speed u (m/min) when the conjugate fiber wound in the package is unwound.

$$\Delta F = 8.0\times10^{-6}u \quad (1)$$

Formula (1) shows the influence of the unwinding speed on the unwinding tension when the conjugate fiber wound in the package is unwound.

If the difference in the unwinding tension is within the range defined by the formula (1), there is none of the yarn breakage occurring in the knitting/weaving process and the false-twist texturing process due to the fluctuation of unwinding tension or the fabric fault such as tight yarn or dyeing abnormality.

For the purpose of assisting the understanding of the formula (1), an area in which the difference in unwinding tension is favorable is shown by oblique lines in FIG. 9. For instance, if the speed of the fiber unwound from the polyester type conjugate fiber package is 1000 m/min, the difference in unwinding tension ΔF (cN/dtex) is preferably 0.008 cN/dtex or less.

(Stretching Elongation Prior to Being Treated with Boiling Water)

The stretching elongation Vc prior to being treated with boiling water of the conjugate yarn layered in the selvage portion of the package is preferably 20% or less, more preferably 10% or less.

The conjugate fiber layered in the selvage portion of the package is liable to have a high stretching elongation Vc prior to being treated with boiling water in comparison with the conjugate fiber layered in the central portion. However, if the stretching elongation Vc prior to being treated with boiling water is 20% or less, the unwinding resistance is small when the conjugate fiber is unwound from the package and therefore there is no tension fluctuation or yarn breakage even at a high unwinding speed.

(Winding Hardness)

The winding hardness of the selvage portion of the package is preferably in a range from 50 to 90. Also, the difference in winding hardness between the opposite selvage portions is preferably 10 or less.

When the winding hardness of the selvage portion is within the above-mentioned range, the package is not collapsed during the transportation or handling, and since the unwinding resistance is small when the conjugate fiber is unwound from the selvage portion, there is no tension fluctuation or yarn breakage even at a high unwinding speed. A favorable range of the winding hardness of the selvage portion is from 60 to 85.

When the difference in winding hardness between the opposite selvage portions; that is, between one selvage portion and the other selvage portion; is 10 or less, there is no tight yarn or dyeing abnormality in the resultant fabric because the difference in unwinding tension becomes small between both the selvage portions.

(Winding Density)

The winding density of the package is preferably in a range from 0.80 to 0.92 g/cm$^3$, more preferably from 0.82 to 0.90 g/cm$^3$. When the winding density is within the above-mentioned range, there is no collapse of the package during the transportation or handling thereof, and, as the unwinding resistance becomes small, there is no tension fluctuation or yarn breakage even at a high unwinding speed.

(Bulge)

The bulge percentage of the polyester type conjugate fiber package according to the present invention is preferably 12% or less, more preferably 10% or less, and furthermore preferably 8% or less. of course, it is most preferably 0%.

When the bulge percentage is 12% or less, the winding tightness of the package due to the shrinkage of the conjugate fiber is less, whereby it is possible to easily remove the package from a spindle of the winder. Also, as the package end is not brought into contact with the wrapping material when the package is bundled, the conjugate fiber is smoothly unwound from the package during the unwinding process.

Conditions peculiar to the polyester type pre-oriented conjugate fiber package according to the present invention will be described below.

The polyester type pre-oriented conjugate fiber is wound in a package and simultaneously satisfies the following items (1) to (4):

(1) the stretching elongation Vc prior to being treated with boiling water is less than 20%, (2) the elongation at break is in a range from 60 to 120%, (3) the dry heat shrinkage stress value is in a range from 0.01 to 0.15 cN/dtex), and (4) the yarn fineness variation value U % is 1.5% or less and the variation coefficient of the yarn fineness variation period is 0.4 or less.

In the present invention, the stretching elongation Vc prior to being treated with boiling water of the polyester type pre-oriented conjugate fiber is less than 20%, preferably 15% or less, and more preferably 10% or less. If the stretching elongation Vc prior to being treated with boiling water is less than 20%, a contact resistance of the fiber with guides or others becomes small during the high-speed false-twist texturing process or the high-speed draw false-twist texturing process and thereby no yarn breakage or fluff generates.

In the present invention, the elongation at break of the polyester type pre-oriented conjugate fiber is in a range from 60 to 120%, preferably from 70 to 100%. The pre-oriented conjugate fiber having the elongation at break within the above-mentioned range is obtainable at a winding speed of approximately 4000 m/min or less to form a package having a smaller selvage height which does not collapse even if it is stored for a long time.

In the present invention, the dry heat shrinkage stress value of the polyester type pre-oriented conjugate fiber is in a range from 0.01 to 0.15 cN/dtex, preferably from 0.03 to 0.10 cN/dtex. If the dry heat shrinkage stress value is within the above-mentioned range, a package having a smaller selvage height is formed which is free from yarn breakage during the winding thereof. While the dry heat shrinkage stress value is preferably as small as possible, it is difficult to produce the fiber having the dry heat shrinkage stress value of less than 0.01.

In the present invention, the yarn fineness variation value U % of the polyester type pre-oriented conjugate fiber is 1.5% or less and the variation coefficient of the yarn fineness variation period is 0.4 or less.

If the yarn fineness variation value U % is 1.5% or less, the resultant fabric is excellent in dyeing uniformity. The yarn fineness variation value U % is preferably 1.2% or less, more preferably 1.0% or less.

If the variation coefficient is 0.4 or less, the resultant fabric is excellent in appearance quality. The variation coefficient is preferably as small as possible. 0.3 or less is particularly favorable.

When the variation coefficient of the yarn fineness variation period exceeds 0.4, a dyeing abnormality may occur in the resultant fabric caused by the selvage portion of the polyester type conjugate fiber package, even if the variation coefficient U % is 1.5% or less, to deteriorate the appearance quality of the fabric. For example, in the woven fabric in which warp yarns and weft yarns are densely interwoven, this dyeing abnormality is liable to occur. Particularly, this phenomenon is significant when the pre-oriented conjugate fiber is supplied to the knitting/weaving process as it is without being subjected to the draw false-twist texturing process.

The crystallization calorific value measured by the differential scanning calorimetry (DSC) of the polyester type pre-oriented conjugate fiber is preferably 10 J/g or less, more preferably 5 J/g or less, furthermore preferably 2 J/g or less. If the crystallization calorific value is 10 J/g or less, the progression of self-crystallization of the pre-oriented conjugate fiber at a high temperature is restricted. The crystallization calorific value is preferably as small as possible.

The crystallization calorific value by the differential scanning calorimetry (DSC) is a value obtained by the measurement described later. The crystallization calorific value is a calorie generated when the pre-oriented conjugate fiber is crystallized, which is a measure of the degree of crystallization. The smaller the crystallization calorific value, the more the crystallization of the pre-oriented conjugate fiber.

The crystallization calorific value of the polyester type pre-oriented conjugate fiber in which the crystallization is hardly progressed exceeds approximately 10 J/g. On the other hand, when the crystallization has sufficiently progressed, the crystallization calorific value becomes 0 J/g according to this method, and the measurement is impossible.

One of the advantages of the pre-oriented conjugate fiber in which the crystallization has been progressed is that when the pre-oriented conjugate fiber is fed to the draw false-twist texturing process and maintained in a hot environment at approximately 40° C. or higher for a long time, the progression of the self-crystallization of the pre-oriented conjugate fiber is restricted. According to this effect, the high-selvage shape and the deformation of the package are reduced whereby the occurrence of the dyeing abnormality of the false-twist textured yarn is minimized.

Another advantage is that the pre-oriented conjugate fiber can be fed to the knitting/weaving process without being subjected to the draw false-twist texturing process to result in a fabric excellent in appearance quality.

Next, conditions peculiar to the polyester type drawn conjugate fiber package according to the present invention will be described below.

The polyester type drawn conjugate fiber is wound in a package and simultaneously satisfies the following items (5) to (8):

(5) the stretching elongation $CE_2$ measured under a load of $2\times10^{-3}$ cN/dtex after being treated with boiling water is in a range from 5 to 100%.

(6) the elongation at break is in a range from 25 to 80%, (7) the dry heat shrinkage stress value is in a range from 0.02 to 0.24 cN/dtex, and (8) the yarn fineness variation value U % is 1.5% or less and the variation coefficient of the yarn fineness variation period is 0.4 or less.

In the present invention, the stretching elongation $CE_2$ measured under a load of $2\times10^{-3}$ cN/dtex after being treated with boiling water is in a range from 5 to 100%, preferably from 10 to 100%, more preferably from 20 to 100%. If the stretching elongation $CE_2$ is within the above-mentioned range, the resultant fabric is excellent in stretchability. In this regard, it is difficult to achieve 100% or more of this value according to the present technology.

The larger the stretching elongation $CE_2$, the higher the stretchability even in a fabric of a structure having a high restriction force such as a woven fabric.

In the present invention, the elongation at break of the polyester type drawn conjugate fiber is in a range from 25 to 80%, preferably from 30 to 60%. If the elongation at break is 25% or more, it is possible to produce the fiber in a stable manner without yarn breakage during the drawing, and a package thereof has a low selvage height whereby no dyeing abnormality occurs in the resultant fabric. If the elongation at break is 80% or less, the tensile strength of the conjugate fiber is approximately 2 cN/dtex or more and is usable for a sportswear application requiring the high strength. Also, there is no dyeing abnormality of thick-and-thin type.

In the present invention, the dry heat shrinkage stress value of the polyester type drawn conjugate fiber is in a range from 0.02 to 0.24 cN/dtex, preferably from 0.05 to 0.15 cN/dtex. If the dry heat shrinkage stress value is within the above-mentioned range, it is possible to form a package having a low selvage height.

The dry heat shrinkage stress value is preferably as small as possible. However, the production of the fiber having this value of less than 0.02 is difficult because the yarn breakage often occurs during the winding.

In the present invention, the yarn fineness variation value U % of the drawn conjugate fiber is 1.5 or less and the variation coefficient of the yarn fineness variation period there of is preferably 0.4 or less.

If the yarn fineness variation value U % is 1.5% or less, a fabric excellent in dyeing uniformity is obtainable. The yarn fineness variation value U % is preferably 1.2% or less, more preferably from 1.0% or less.

If the variation coefficient is 0.4 or less, a fabric excellent in appearance quality is obtainable. The variation coefficient is preferably as small as possible, and 0.3 or less is particularly favorable.

When the variation coefficient of the yarn fineness variation period exceeds 0.4, there may be a case in that the dyeing abnormality occurs in the resultant fabric due to the selvage portion of the drawn conjugate fiber package to degrade the fabric even if the yarn fineness variation value U % is 1.5% or less. For example, this tendency is significant in a woven fabric in which warp yarn and weft yarns are densely interwoven, particularly, when the drawn conjugate fiber is fed to the knitting/weaving process as it is without being subjected to the false-twist texturing process.

Favorable conditions common to the polyester type pre-oriented conjugate fiber and the polyester type drawn conjugate fiber will be described below:

Preferably, the fiber-fiber dynamic friction coefficient is in a range from 0.20 to 0.35 and the difference therein between maximum and minimum values in the yarn length direction is 0.05 or less.

If the fiber-fiber dynamic friction coefficient is within the above-mentioned range, it is possible to form a package of 2 kg or more since the fiber does not slip off from the package. Also, since the unwinding tension becomes small when the conjugate fiber is unwound from the package, there is no yarn breakage or dyeing abnormality.

If the difference in the coefficient of friction between maximum and minimum values in the yarn length direction is 0.5 or less, it is possible to further reduce the fluctuation of the unwinding tension.

The difference in stress value at 10% elongation in the stress-strain measurement between maximum and minimum values is preferably 0.30 cN/dtex or less in the yarn length direction. The present inventors have found that the stress value at 10% elongation in the stress-strain measurement has a good correspondence with the dyeing uniformity in the yarn length direction and if the difference between the maximum and minimum values is 0.30 cN/dtex or less in the yarn length direction, a fabric excellent in dyeing uniformity is obtainable. The difference in stress value at 10% elongation between maximum and minimum values is preferably as small as possible, and if it is 0.2 cN/dtex or less, a fabric further excellent in dyeing uniformity is obtainable.

While there is no limitation in the yarn fineness or a single filament fineness of the polyester type conjugate fiber, the yarn fineness is preferably in a range from 20 to 300 dtex and the single filament fineness is preferably in a range from 0.5 to 20 dtex.

There is no limitation in the single filament cross section, which may include modified cross section other than a circle, such as a triangle, an oval, a flat shape, a W-shape or an X-shape. Particularly, it is possible to exhibit excellent dyeing uniformity as well as good stretchability if the degree of modified cross section is in a range from 1 to 5.

In the present invention, the polyester type conjugate fiber may be used as a long filament yarn or staple fibers cut into a length in a range from 20 to 200 mm. In either cases, excellent dyeing uniformity as well as good stretchability are obtainable.

The polyester type conjugate fiber according to the present invention may be mixed or copolymerized with titanium oxide as delusterant, thermal stabilizer, antioxidnat, antistatic agent, ultraviolet absorber, antifungus agent or various pigment unless it disturbs the effect of the present invention.

Also, a finishing agent in a range from 0.2 to 2 wt % is preferably applied to the polyester type conjugate fiber for the purpose of imparting the fiber with smoothness, filament cohesion and antistatic property. Further, for the purpose of improving the unwinding property and the filament cohesion during the unwinding or false-twist texturing process, the single filaments may be interlaced with each other at 2 to 50 points/m.

A method for producing the polyester type conjugate fiber package according to the present invention will be described below.

The polyester type conjugate fiber package according to the present invention can be produced by a conjugate fiber spinning apparatus including a spinneret and a two-shaft extruder described below.

FIG. 10 illustrates a schematic view of one example of a spinneret used for the production of the polyester type conjugate fiber package according to the present invention.

In FIG. 10, (a) denotes a distributor and (b) denotes a spinning nozzle. The two kinds of polyesters having different intrinsic viscosity values are introduced from P and Q, respectively, and fed to the spinning nozzle (b) from the distributor (a). After the both are joined together in the spinning nozzle (b), the joined stream is extruded from the spinning orifice slanted at θ degrees relative to the vertical direction. A diameter of the orifice is represented by D and a length thereof is represented by L.

In the present invention, a ratio of the length L to the diameter D (L/D) is preferably 2 or more. If L/D is 2 or more, both the components having different intrinsic viscosity values are stably adhered to each other after being joined together whereby no vibration occurs in the extruded stream. Thus, it is possible to maintain the yarn fineness variation value U % of the resultant fiber within the range defined by the present invention. L/D is preferably as large as possible. However, in view of the ease of manufacture of the spinneret, L/D is more preferably in a range from 2 to 8, furthermore preferably from 2.5 to 5.

In the present invention, the spinning orifice has the inclination in a range from 10 to 40 degrees relative to the vertical direction. The inclination angle of the spinning orifice relative to the vertical line is represented by θ (degrees) in FIG. 10.

This inclination of the spinning orifice relative to the vertical direction is an important condition for preventing the yarn bending from occurring due to the difference in intrinsic viscosity between the two kinds of polyester components. If there is no inclination in the spinning orifice, the filament yarn as extruded from the orifice is liable to bend toward the higher intrinsic viscosity side as the difference in intrinsic viscosity is larger. This is called a bending phenomenon which disturbs the stable spinning. Also, the yarn fineness variation value U % of the resultant conjugate fiber becomes larger to deteriorate the dyeing uniformity.

In FIG. 10, preferably, the polyester having a higher intrinsic viscosity is supplied to the side P and that having a lower intrinsic viscosity is supplied to the side Q.

FIG. 11 is a schematic illustration of one example of a spinning apparatus used for carrying out the method according to the present invention. Based on this drawing, a preferable production method will be described.

In FIG. 11, pellets of one polyester component are dried by a dryer 1 to have a moisture content of 20 ppm or less and supplied to an extruder 2 maintained at a temperature in a range from 250 to 280° C. in which the pellets are melted. Pellets of the other polyester component are also supplied to an extruder 4 via a dryer 3 and melted in the same manner as before.

The melted polyester components are supplied via bends 5 and 6, respectively, to a spin head 7 maintained at a temperature in a range from 250 to 285° C., and weighed separately by gear pumps. Then, the two kinds of components are joined together in a spinneret 9 which has a plurality of orifices and is mounted to a spinning pack 8. After they are adhered with each other to form a side-by-side type or an eccentric sheath/core type conjugate fiber, the components are extruded in a spinning chamber as a filament yarn of the conjugate fiber 10.

The optimum temperature of the extruder and the spin head is selected from the above-mentioned range in accordance with kinds or intrinsic viscosity values of the polyester.

The filament yarn 10 extruded into the spinning chamber is cooled, by cooling air 12, to room temperature and solidified. After being imparted with a finishing agent by a finishing agent applicator 13, the filament yarn is taken up by a first godet roll 14 rotating at a predetermined speed.

The finishing agent is preferably of an aqueous emulsion type, a concentration of which is preferably 10 wt % or more, more preferably in a range from 15 to 30 wt %. The finishing agent preferably contains fatty acid ester and/or mineral oil in a range from 10 to 80 wt % or polyether having a molecular weight of 1000 to 20000 in a range from 50 to 98 wt %, which is preferably imparted to the fiber in a range from 0.3 to 1.5 wt %. By the application of such a finishing agent, it is possible to control the fiber-fiber dynamic friction coefficient within a range from 0.2 to 0.35 so that the unwinding property of the conjugate fiber from the package is improved and yarn breakage is prevented from occurring during the false-twist texturing process or the knitting/weaving process.

If necessary, an interlacer may be provided between the finishing agent applicator 13 and the first godet roll 14, between the first godet roll 14 and a second godet roll 15 or between the second godet roll 15 and a winder to impart the yarn with intermingling. The interlacer may be of a known type wherein a fluid pressure is preferably adjusted to a value in a range from 0.01 to 0.6 MPa to impart the yarn with intermingling in a range from 2 to 50 points/m.

According to the present invention, the spinning tension is 0.30 cN/dtex or less, preferably 0.20 cN/dtex or less, more preferably 0.15 cN/dtex or less. The spinning tension is preferably as small as possible. However, if this value is 0.3 cN/dtex or less, it is possible to continuously produce the fiber in a stable state because there is no yarn breakage caused by the frictional abrasion of the fiber with the finishing agent applicator.

The spinning tension is a value dividing a yarn tension (cN) measured at a position apart downward from the finishing agent applicator 13 in FIG. 11 by approximately 10 cm by the yarn fineness (dtex) of the conjugate fiber on the take-up godet roll.

The spinning tension is suitably adjustable in accordance with the collecting methods of the filament yarn. For example, the spinning tension may be adjustable in accordance with spinning speeds, distances from the spinneret to a position at which the yarn is collected, and kinds of collecting guides. The application of the finishing agent is preferably carried out simultaneously with the collection of the filament yarn.

In the production method according to the present invention, it is important that the winding package is maintained at a temperature of 30° C. or lower. By maintaining the temperature of the winding package at 30° C. or lower, it is possible to eliminate a high-selvage shape of the package or the drawbacks of the fiber in the selvage portion of the package due to the shrinkage of the conjugate fiber. If the package temperature exceeds 30° C., the variation coefficient of the yarn fineness variation period becomes larger than 0.4 even though the yarn fineness variation value U % is suppressed as low as possible, whereby the object of the present invention is not achievable. This fact has been found for the first time by the present inventors and is one of important characteristics of the present invention. As the package temperature during winding exceeds approximately 40° C. in the prior art high speed winding, the drawbacks of the fiber in the selvage portion have not been eliminated.

The package temperature is preferably maintained at 30° C. or lower from the commencement to the completion of the winding operation. As means for maintaining the package temperature at 30° C. or lower, heat conduction and heat radiation from a motor which is a drive source of the winder and a heat-generation source for the bobbin shaft are preferably intercepted. In addition, the winding package and the surrounding area thereof are preferably cooled by cooling air for achieving the above object.

The package temperature during winding is preferably as low as possible. Approximately 25° C. or lower is more preferable. Since a large amount of energy is necessary for maintaining an excessively low temperature, the package temperature is more preferably in a range from approximately 20 to 25° C.

According to the production method according to the present invention, the winding speed is in a range from 1500 to 4000 m/min, preferably from 1800 to 3500 m/min, more preferably from 2000 to 3300 m/min. If the winding speed is within the above range, the degree of orientation of the conjugate fiber being spun is sufficiently high and the yarn fineness variation value U % and the yarn fineness variation coefficient are within the range defined by the present invention. Also, since the spinning tension and the drawing tension are not retained in the wound fiber, the difference in the dry heat shrinkage stress value between the selvage portion and the central portion of the package is 0.05 cN/dtex or less to achieve the object of the present invention. When the heat treatment is carried out during the winding process, the tension is maintained at 0.02 cN/dtex or more to minimize the yarn fineness variation, whereby no yarn breakage or fluff generates, even though the heat treatment temperature exceeds 70° C.

Next, conditions peculiar to the method for producing the polyester type pre-oriented conjugate fiber package according to the present invention will be described below.

In FIG. 11, the conjugate fiber taken up by the first godet roll 14 is wound as a pre-oriented conjugate fiber package 16 via a second godet roll 15 without being substantially drawn.

At least one of the first godet roll 14 and the second godet roll 15 is preferably heated as a hot godet roll so that the pre-oriented conjugate fiber is heat-treated prior to being wound in the package. The heat treatment is not limited to only that using the hot godet roll but may be carried out by any method provided the fiber can be heat-treated before it is wound in the package.

The heat-treatment condition for the pre-oriented conjugate fiber is preferably in that the heat-treatment temperature is in a range from 70 to 120° C. and the heat-treatment tension is in a range from 0.02 to 0.1 cN/dtex. The heat treatment is preferably carried out by wrapping the pre-oriented conjugate fiber 2 to 10 times around the hot godet roll. In this case, the temperature of the hot godet roll is preferably maintained at a level generally equal to the heat-treatment temperature of the pre-oriented conjugate fiber.

If the heat-treatment temperature is 70° C. or higher, the crystallization calorific value of the resultant pre-oriented conjugate fiber is 10 J/g or less so that the object of the present invention is more effectively achievable. When the heat-treatment temperature exceeds 120° C., the yarn vibration becomes significant on the godet roll because the pre-oriented conjugate fiber having a low crystallization degree is abruptly brought into contact with the high temperature to cause the generation of fluff or yarn breakage, whereby it is difficult to maintain stable production. Also, the yarn fineness variation value U % of the resultant pre-oriented fiber exceeds 1.5%. Thus, the heat-treatment temperature is preferably in a range from 80 to 110° C., more preferably from 90 to 110° C.

The heat-treatment tension of the pre-oriented conjugate fiber is measured on the hot godet roll or at a position directly after it departs from the hot godet roll. The adjustment of this tension is carried out by regulating the temperature and the speed of the hot godet roll. If the heat-treatment tension is within the above-mentioned range, the yarn vibration on the godet roll is minimized and the running of the pre-oriented conjugate fiber becomes stable. Also, there is no tight winding of the package. The heat-treatment tension is preferably in a range from 0.03 to 0.07 cN/dtex.

While there is no limitation in the heat-treatment time, a range from approximately 0.01 to 0.1 second is generally employed.

Next, conditions peculiar to the method for producing the polyester type drawn conjugate fiber package according to the present invention will be described below.

In FIG. 11, when the polyester type drawn conjugate fiber package is produced, the conjugate fiber taken up by the first godet roll 14 is continuously drawn by the second godet roll without being once wound in a package, and then wound by the winder to form a predetermined drawn conjugate fiber package 16.

During the drawing, a temperature of the first godet roll 14 is preferably maintained in a range from 50 to 90° C., more preferably from 55 to 70° C. The second godet roll 15 is heated so that the drawn yarn is heat-treated by the second godet roll 15. The heat-treatment temperature is preferably in a range from 90 to 160° C., more preferably from 100 to 140° C.

In the present invention, it is necessary that the drawing tension is in a range from 0.05 to 0.40 cN/dtex, preferably from 0.10 to 0.30 cN/dtex. If the drawing tension is within the above range, the polyester type drawn conjugate fiber has a sufficient tensile strength of approximately 1.5 cN/dtex. Also, the elongation at break thereof is 30% or more whereby no fluff or yarn breakage occurs during the drawing. The drawing tension is defined by a speed ratio between the first godet roll 14 and the second godet roll 15.

The drawing tension is determined by selecting the combination of a ratio in the peripheral speed between the first and second godet rolls; i.e., a draw ratio; and the temperature of the first godet roll. When the first godet roll has a speed in a range from 1500 to 3000 m/min and a temperature in a range from 50 to 90° C., the drawing tension in a favorable range is obtainable by adjusting the draw ratio to a value in a range from 1.4 to 2.5 times. The draw ratio is preferably in a range from 1.4 to 2.0 times. According to a known direct spin-draw method, the drawing tension reaches as high as approximately 0.5 cN/dtex or more when the draw ratio is in a range from 3 to 5 times. Contrarily, according to the present invention, the drawing is carried out at a further low drawing tension.

In the present invention, the peripheral speed $V_R$ of the hot second godet roll 15 is preferably in a range from 2000 to 4000 m/min, more preferably from 2400 to 3300 m/min. If the peripheral speed $V_R$ is within the above range, it is possible to cause the first godet roll to rotate at a peripheral speed of 1500 m/min or more, whereby the vibration of the filament yarn becomes small to stabilize the running of the yarn during the spinning and the drawing. Also, as the shrinkage of the polyester type drawn conjugate fiber is minimized during the winding or after being wound in the package, the height of the selvage portion of the package is low to reduce the tension fluctuation when the fiber is unwound from the package at a high speed.

Two or three pairs or more of the godet rolls are used in the present invention. A pair of pretension rolls may be provided in front of the take-up godet roll. An apparatus suitable for producing the polyester type drawn conjugate fiber is that having three pairs of godet rolls as shown in FIG. 12.

A third godet roll 17 may be either heated or non-heated. However, the hot godet roll is preferable for the purpose of obtaining the dry heat shrinkage stress value in a range from 0.02 to 0.24 cN/dtex of the polyester type drawn conjugate fiber and facilitating the stretching elongation $CE_2$ thereof. When the hot third godet roll is used, the temperature thereof is preferably in a range from 50 to 180° C., more preferably from 90 to 150° C. If the temperature is within this range, the winding is carried out in a stable state without the occurrence of yarn breakage.

In the present invention, if the heat set is carried out between the second godet roll 15 and the third godet roll 17 under the tension in a range from 0.05 to 0.5 cN/dtex, it is possible to make the stretching elongation $CE_2$ as high as 5% or more. The tension between the second godet roll 15 and the third godet roll 17 can be determined by a speed ratio between the both. The speed ratio between the second and third godet rolls is preferably in a range from 1.0 to 1.1.

In the present invention, the winding is preferably carried out so that a ratio $V_W/V_R$ satisfies the following formula (2):

$$0.85 \leqq V_W/V_R \leqq 1 \quad (2)$$

wherein $V_W$ is a winding speed and $V_R$ is a speed of the hot second godet roll.

To assist the understanding of the formula (2), a favorable area is shown in FIG. 13 in relation to $V_R$ and $V_W/V_R$. In FIG. 13, a horizontal axis represents the speed $V_R$ of the second godet roll and a vertical axis represents the ratio $V_W/V_R$. That is, the speed ratio $V_W/V_R$ means a relax ratio from the second godet roll to the winder.

In the present invention, the ratio $V_W/V_R$ is preferably 0.85 or more. If the ratio $V_W/V_R$ is less than 0.85, the tension lowers between the second godet roll and the winder, which may disturb the stable winding. The ratio $V_W/V_R$ is preferably in a range from 0.90 to 0.96.

In the present invention, the winding is preferably carried out satisfying the formula (2) at a speed ratio so that the winding tension between the second godet roll 15 and the winder in FIG. 11 or between the third godet roll and the winder in FIG. 12 becomes preferably in a range from 0.02 to 0.12 cN/dtex, more preferably from 0.04 to 0.07 cN/dtex. If the winding tension is within the above range, a high-selvage shaped package or a bulged package does not result.

According to the production method of the present invention, the traverse angle is changed preferably in a range from 3 to 10 degrees, more preferably from 4 to 9 degrees from the commencement to the completion of the package formation in accordance with the respective winding diameters of the package. If the traverse angle is within the above range, no collapse occurs whereby a normal-shaped package is obtainable, free from a high-selvage portion. The traverse angle is determined by adjusting the winding speed and the traverse speed.

In the present invention, the traverse angle in the middle yarn layer of the package is preferably larger than that in the innermost yarn layer. In this regard, the innermost yarn layer of the package is a layer existing within a thickness of approximately 10 mm from the bobbin surface. According to the most favorable aspect for changing the traverse angle in accordance with the winding diameters, the traverse angle is small at the beginning of the winding; i.e., in the innermost yarn layer of the package; and gradually increases as the enlargement of the winding diameter to reach the maximum value in the middle yarn layer, after which the traverse angle reduces again in the outermost yarn layer. By changing the traverse angle in accordance with the winding diameter in such a manner, it is possible to sufficiently minimize both of the bulge and the high-selvage of the package.

The above-mentioned method for winding the yarn while changing the traverse angle in accordance with the winding diameters is also applicable to the method for producing the polyester type pre-oriented conjugate fiber described before, and results in a favorable effect.

A method for producing a false-twist textured yarn of the polyester type conjugated fiber according to the present invention will be described below.

This method is most effective for the false-twist texturing process of the polyester type pre-oriented conjugate fiber.

In the present invention, when the polyester type pre-oriented conjugate fiber in the package is subjected to the draw false-twist texturing process or the polyester type drawn conjugate fiber in the package is subjected to the false-twist texturing process, the temperature of the package is maintained at 30° C. or lower, preferably 25° C. or lower, throughout all the processes including the winding, the storage and the false-twist texturing. If the temperature is within the above range, no high-selvage occurs in the package during the period from the storage to the false-twist texturing, whereby a false-twist textured yarn excellent in appearance quality is obtainable.

The false-twist texturing process may be of a conventional type such as a pin type, a friction type, a nip-belt type or an air twist type. While a false-twist texturing heater may be either of a single heater type or a double heater type, the former type is favorable for the purpose of obtaining a high stretchability.

The heater temperature is determined so that a yarn temperature becomes 130 to 200° C., preferably 150 to 180° C., more preferably 160 to 180° C. measured at a position directly after an exit of the first heater.

The false-twist texturing heater may be of a touch type or a non-touch type.

The stretching elongation $CE_2$ of the false-twist textured yarn obtained by the single-heater type false-twist texturing process is preferably in a range from 50 to 250% and a stretching modulus is preferably 80% or more.

If necessary, a second heater may be used for the heat setting to obtain a double-heater-type false-twist textured yarn. The temperature of the second heater is preferably in a range from 100 to 210° C., more preferably in a range from −30 to +50° C. relative to the yarn temperature measured at a position directly after an exit of the first heater.

An overfeed ratio in the second heater (a second overfeed ratio) is preferably in a range from +3% to +30%.

The false-twist textured yarn of the polyester type conjugate fiber in the inventive package is good in appearance and free from dyeing unevenness as well as excellent in stretchability and stretch-back property.

For example, the stretching elongation of apparent crimp which is visible prior to being treated with boiling water is in a range from 50 to 300%. It is important that the fiber has a large apparent crimp visible prior to being treated with boiling water, for obtaining a fabric excellent in elongation recovery; i.e., the stretchability and instantaneous recovery; because such a fiber can remarkably develop crimps, by the boiling water treatment, even if it is used in a fabric having a large restriction force such as a woven fabric.

If the false-twist textured yarn of the polyester type conjugate fiber obtained by the present invention is used for a weft yarn, a gray fabric prior to being treated with boiling water also has the stretchability as well as a resultant woven fabric has. This property has never been seen in a conventional woven fabric in which known false-twist textured yarn or latent crimp conjugate fiber is used.

The false-twist textured yarn of the polyester type conjugate fiber obtained by the present invention has the stretching elongation $CE_2$ measured under a load of $2\times10^{-3}$ cN/dtex after being treated with boiling water in a range from 50 to 250% and exhibits a high crimp development property, which is one of characteristic of the present invention.

It will be understood that the false-twist textured yarn according to the present invention exhibits an extremely high crimp performance in comparison with a fact that a known false-twist textured yarn obtained by false-twist texturing a conventional fiber consisting solely of PTT has the stretching elongation of approximately 30%.

Further, another characteristic of the polyester type conjugate fiber is that the elongation recovery speed, after being treated with boiling water, is in a range from 20 to 50 m/sec which is a proof of the excellent instantaneous recovery. The stretching recovery speed is measured in such a manner that, after the false-twist textured yarn of the polyester type conjugate fiber is treated with boiling water under no load, the crimp thereof is stretched until a stress reaches a predetermined value, after which the fiber is severed and a speed at which the fiber returns to the original length is measured. The larger the stretching recovery speed, the faster the stretching recovery of the fabric; that is, the more excellent the adaptability to the body movement when the yarn is used for the clothing fabric.

If the stretching recovery speed is 15 m/sec or more in the knitted fabric and 20 m/sec or more in the woven fabric, the fabric excellent in adaptability to the body movement is obtainable. If the stretching recovery speed is less than this value, the adaptability to the body movement becomes insufficient when the yarn is knitted or woven into the fabric. The stretching recovery speed is preferably 20 m/sec or more in the knitted fabric and 25 m/sec or more in the woven fabric. As apparent from a fact that the stretching recovery speed of a known spandex type elastomeric fiber is in a range from approximately 30 to 50 m/sec, it will be understood that the false-twist textured yarn of the polyester type conjugate fiber according to the present invention has the stretching recovery as good as the spandex type elastomeric fiber. In this regard, it is difficult, at the present technical level, to produce a fiber having the stretching recovery speed of 50 m/sec or more.

The stretching recovery speed of a known PET type false-twist textured yarn is approximately 10 m/sec, and that of a false-twist textured yarn of a fiber consisting solely of PTT is approximately 15 m/sec.

The measurement of the stretching recovery speed described above has been invented by the present inventors, and the stretch-back property was quantitatively measured for the first time.

A fabric obtained by using the polyester type conjugate fiber according to the present invention which is not subjected to the false-twist texturing process is also free from periodic dyeing unevenness and good in appearance quality as well as soft hand touch.

The polyester type conjugate fiber according to the present invention may be used for forming all of a fabric, or may be mixed with other fibers and used for forming part of the fabric. The other fibers to be mixed therewith are, for example, polyester fiber, cellulose fiber, nylon 6 fiber, nylon 66 fiber, acetate fiber, acrylic fiber, polyurethane elastomeric fiber, wool or silk including a filament type and a staple fiber type, but should not be limited thereto.

To obtain a mixed fiber composite yarn by mixing or combining the polyester type conjugate fiber according to the present invention with other fibers, various methods may be employed; for example, a method in which the inventive fiber is interlace-mixed with other fibers; a method in which the interlace-mixed fibers are draw false-twist textured; a method in which one of the fibers is false-twist textured and then interlace-mixed with the other; a method in which both fibers are separately false-twist textured and then interlace-mixed together; a method in which one of the fibers is Taslan-processed and then interlace-mixed with the other; and a method in which both fibers are Taslan-mixed. The mixed fiber composite yarn obtained by the above methods is preferably has intermingling portions of 10 point/m or more.

18: a bobbin used for the winding, 19: a wound conjugate fiber, 20: a high-selvage portion, K: a winding diameter, H: a winding width, A: a winding width of the innermost layer of the package, B: a winding width when the yarn layer has a predetermined thickness, T: a winding thickness, α: a selvage diameter, β: a diameter of a central portion, and ϕ: a traverse angle.

Figure 3:
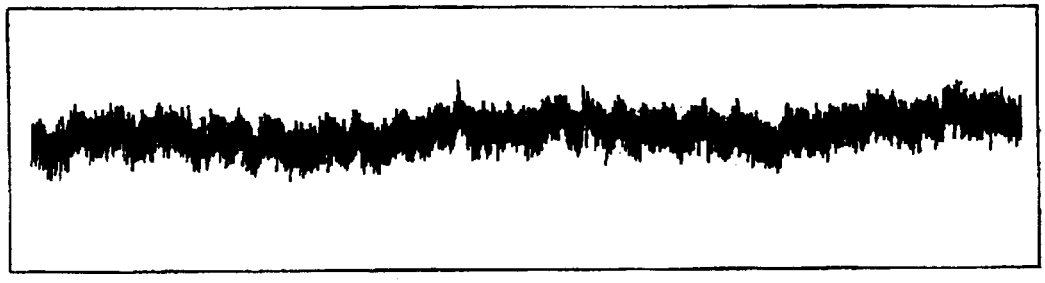
Figure 4:
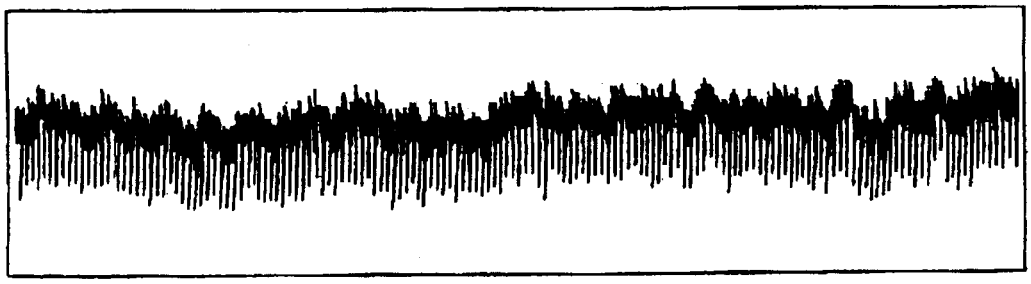
Figure 5:
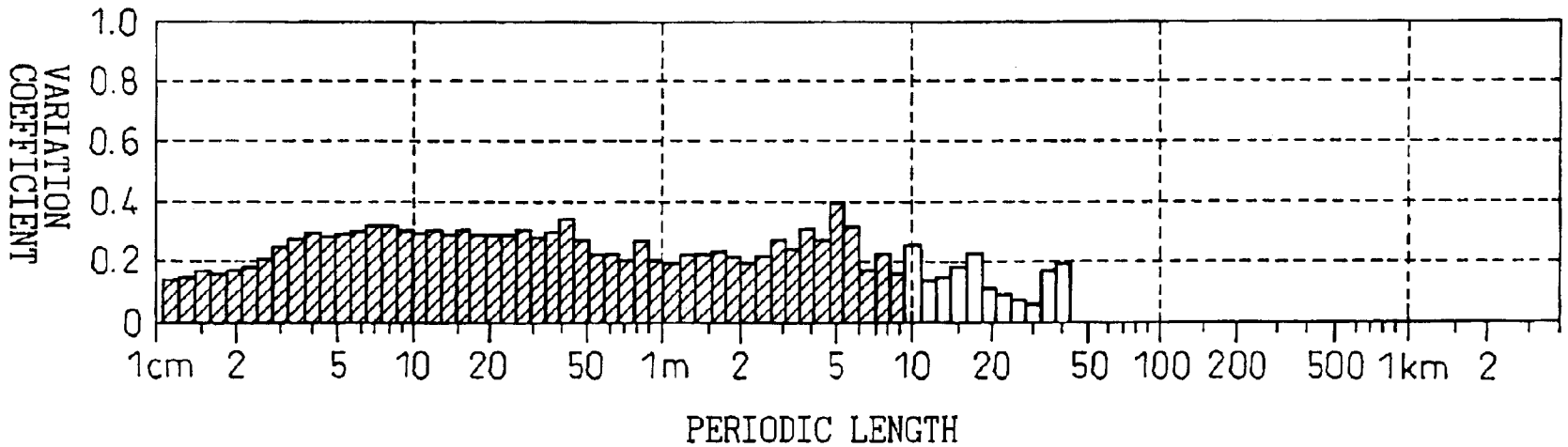
Figure 6:
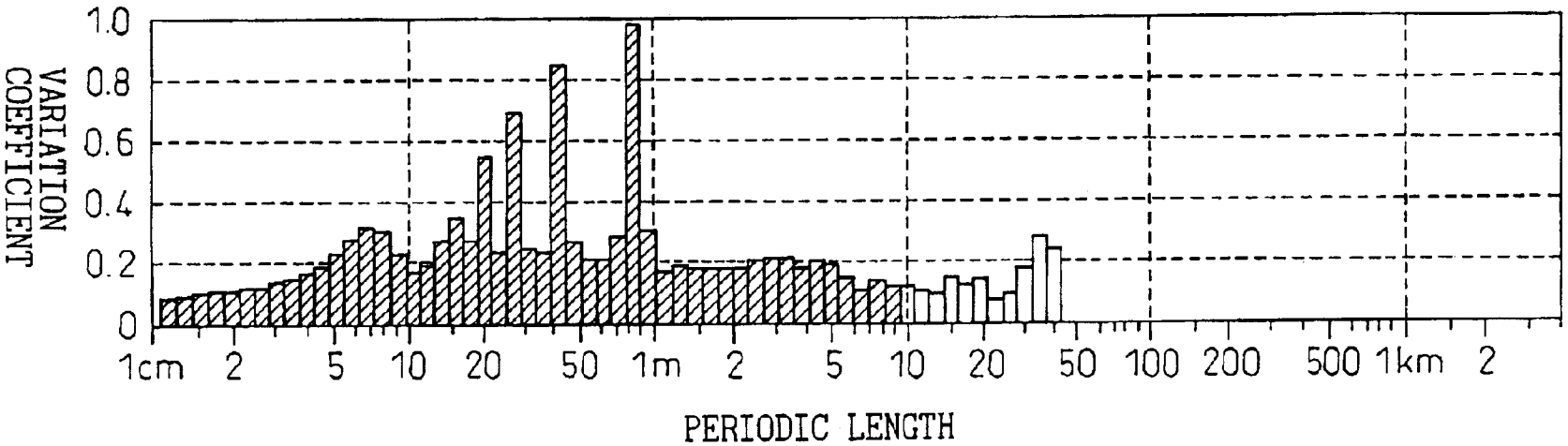
Figure 7:
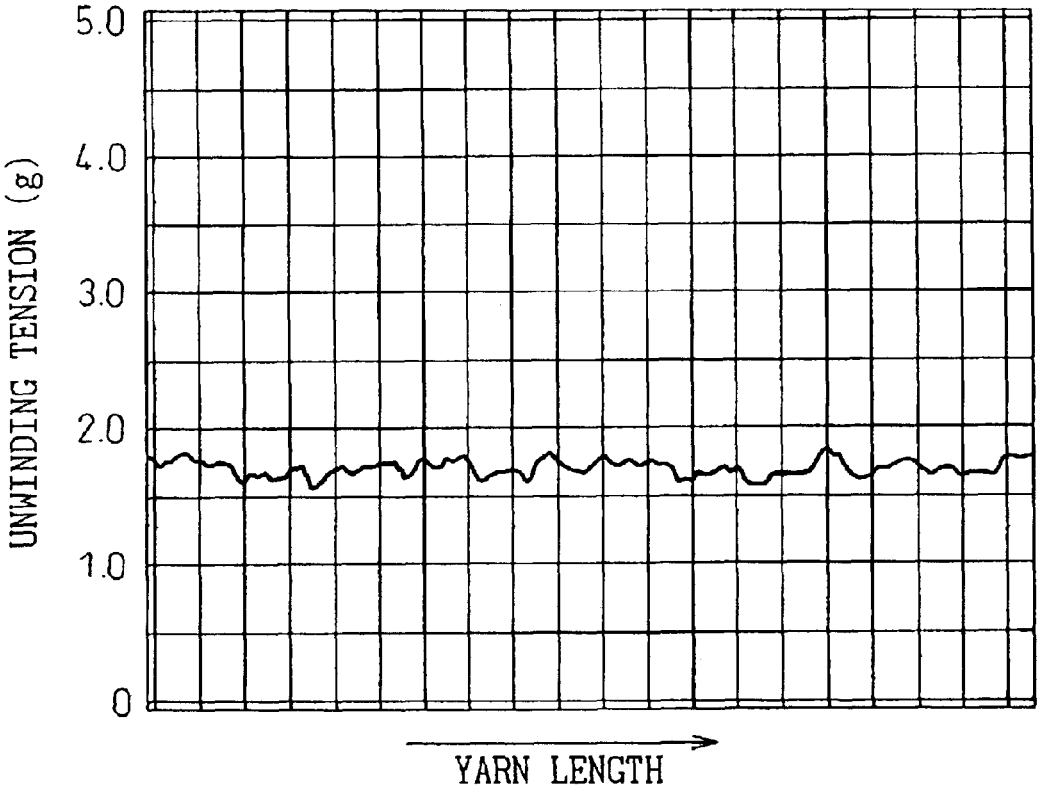
Figure 8:
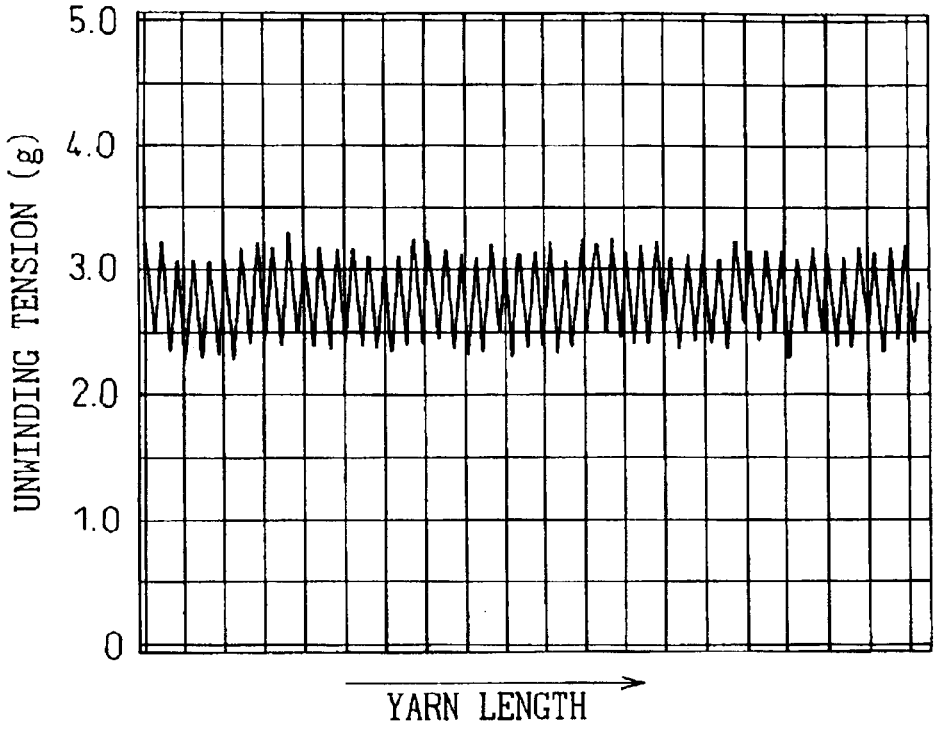
Figure 9:
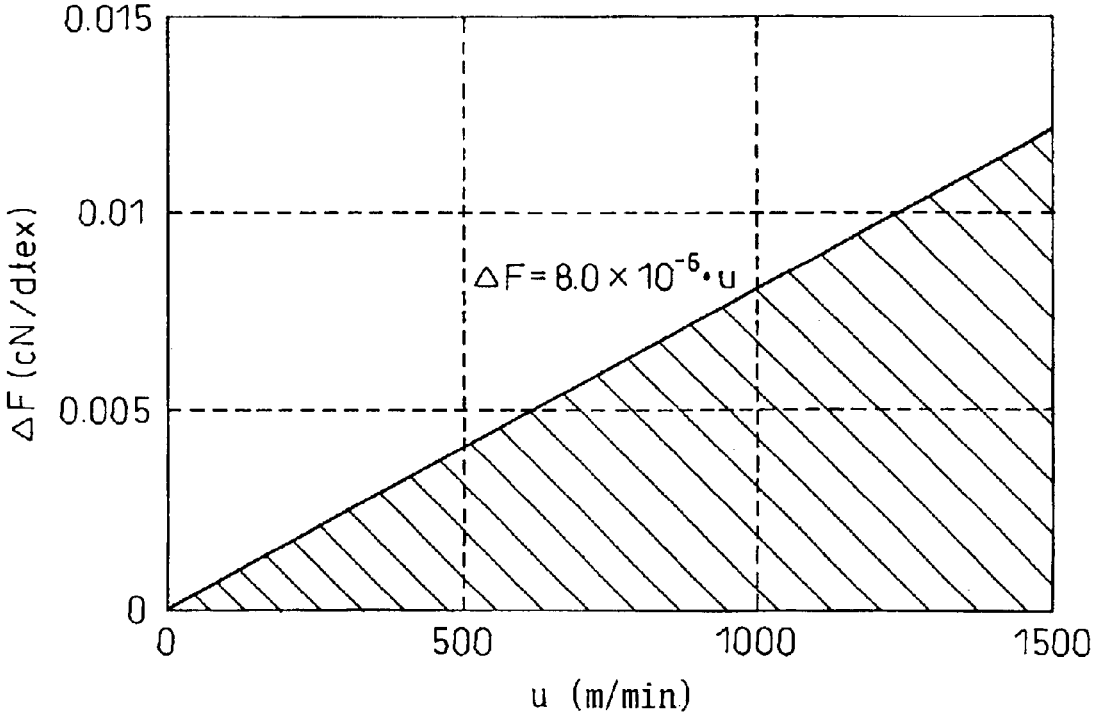
Figure 10:
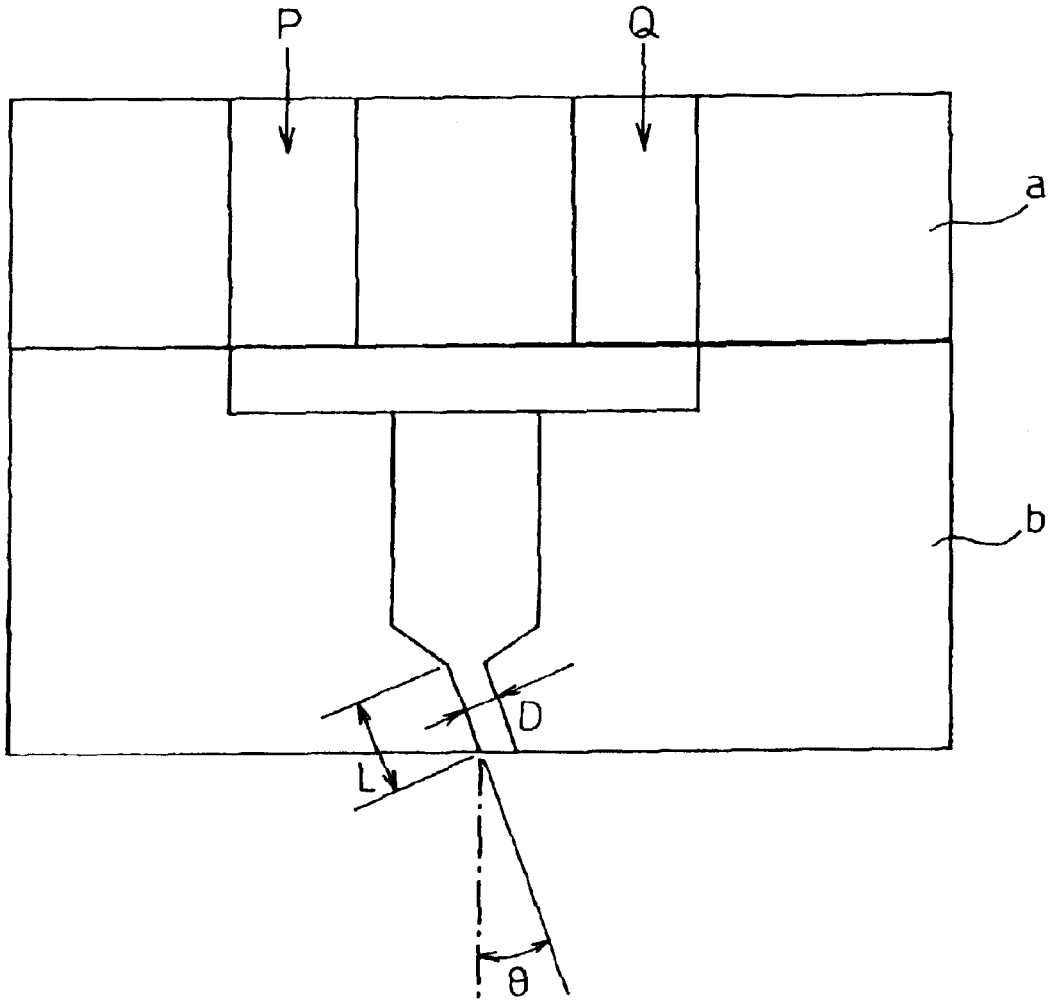
Figure 11:
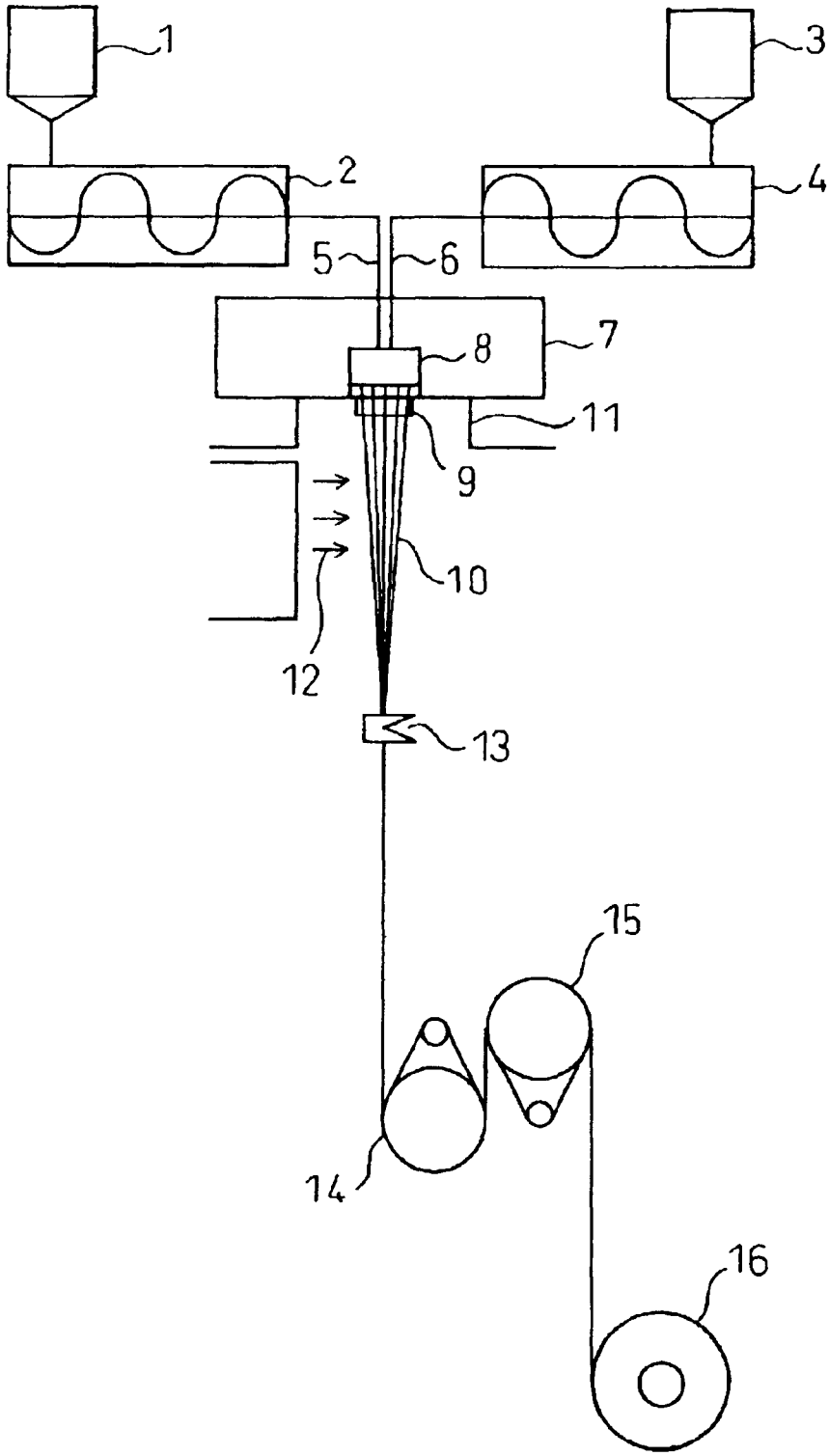
Figure 12:
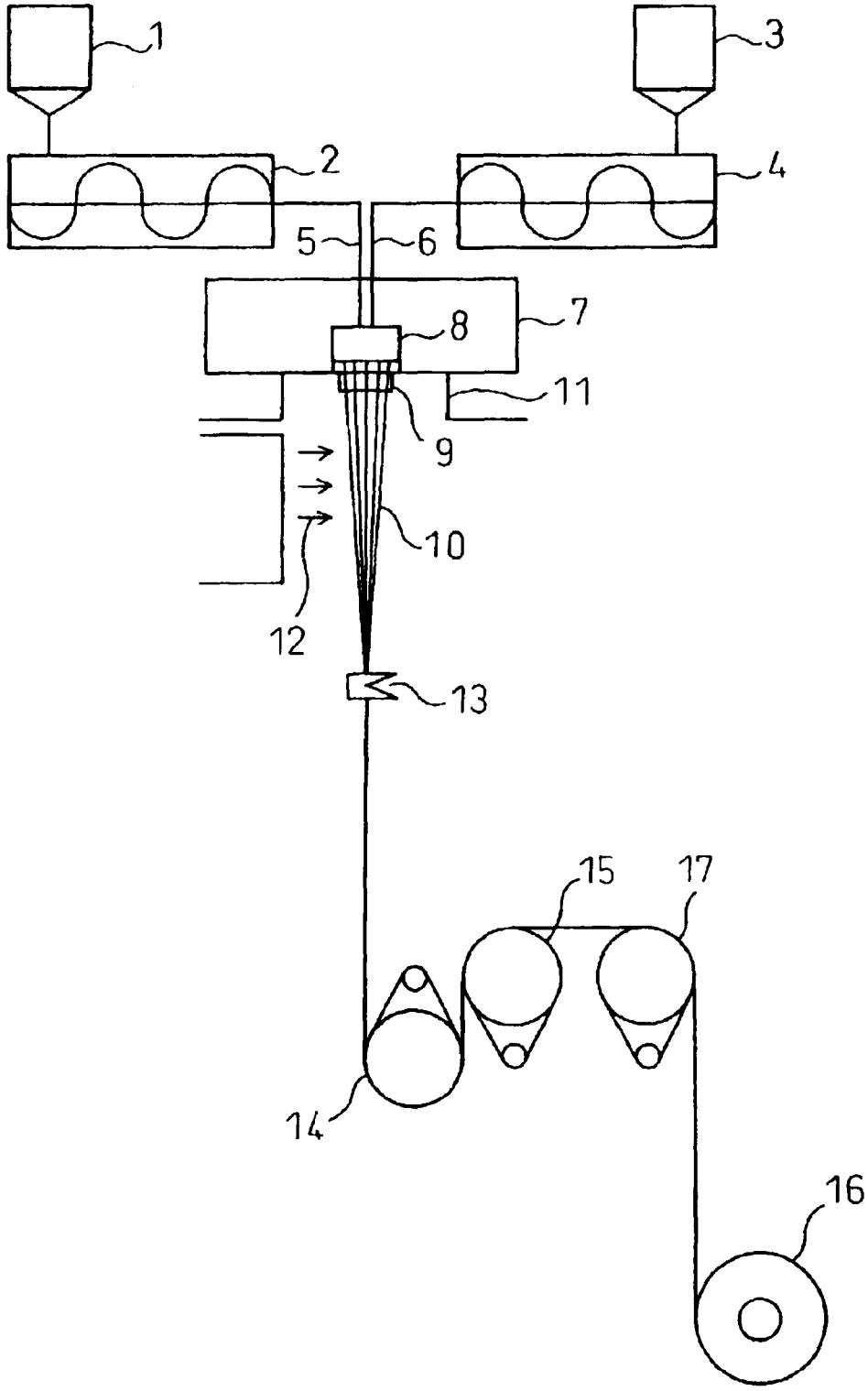
Figure 13:
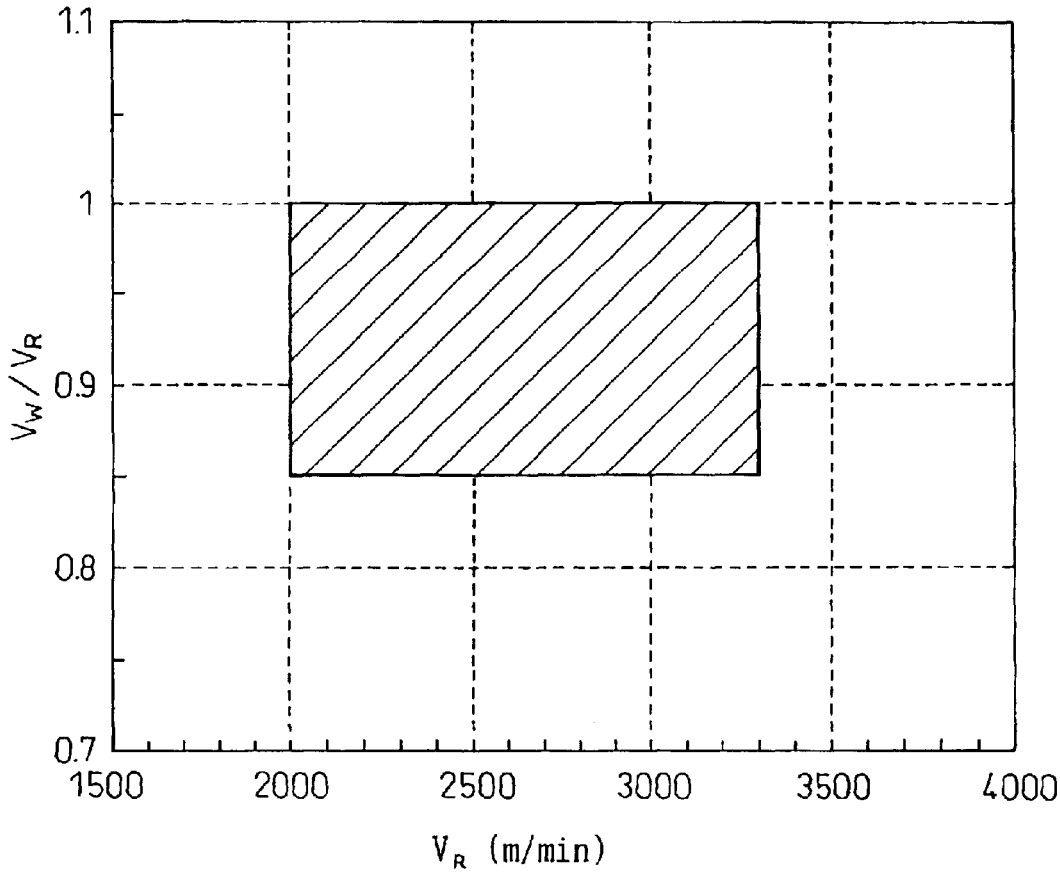

FIG. 3 is one example of a measurement chart of the yarn fineness variation value U %;

FIG. 4 is another example of a measurement chart of the yarn fineness variation value U %;

FIG. 5 is one example of a yarn fineness variation period analysis chart;

FIG. 6 is another example of a yarn fineness variation period analysis chart;

FIG. 7 is one example of an unwinding tension fluctuation chart;

FIG. 8 is another example of an unwinding tension fluctuation chart;

FIG. 9 is a chart showing a favorable area of the difference in unwinding tension and an unwinding speed according to the present invention;

FIG. 10 is a schematic illustration of one example of a spinneret used in the present invention; wherein reference numerals are as follows:

a: a distributor, b: a spinning orifice, D; an orifice diameter, L: an orifice length, θ: an inclination angle, P: a polymer supply port, and Q: a polymer supply port;

FIG. 11 is a schematic illustration of one example of a process for producing a conjugate fiber package;

FIG. 12 is another schematic illustration of one example of a process for producing a conjugate fiber package; and FIG. 13 is a chart showing a favorable area of the winding condition according to the present invention. In FIG. 11 and FIG. 12, reference numerals are as follows:

1: a dryer, 2: an extruder, 3: a dryer, 4: an extruder, 5: a bend, 6: bend, 7: a spin head, 8: a spin pack, 9: a spinneret, 10: a filament, 11: a non-air blowing area, 12: cooling air, 13: a finishing agent applicator, 14: a first godet roll, 15: a second godet roll, 16: a conjugate fiber package, 17: and a third godet roll.

BEST MODES FOR CARRYING OUT THE INVENTION

The present invention will be described in more detail below by making reference to examples, but should not be limited thereto.

In this regard, the measuring methods or the estimation methods are as follows:

(1) Intrinsic Viscosity

The intrinsic viscosity [η] is a value determined by the definition represented by the following formula:

$$[\eta]=\lim_{C\to 0}(\eta r-1)/C$$

wherein ηr is a value obtained by dividing a viscosity of a diluted solution of the polymer dissolved in o-chlorophenol having a purity of 98% or more by a viscosity of the above solvent measured at the same temperature, which is defined as a relative viscosity. C is a polymer concentration represented by g/100 ml.

(2) Difference in Winding Diameter of Package

Figure 2:
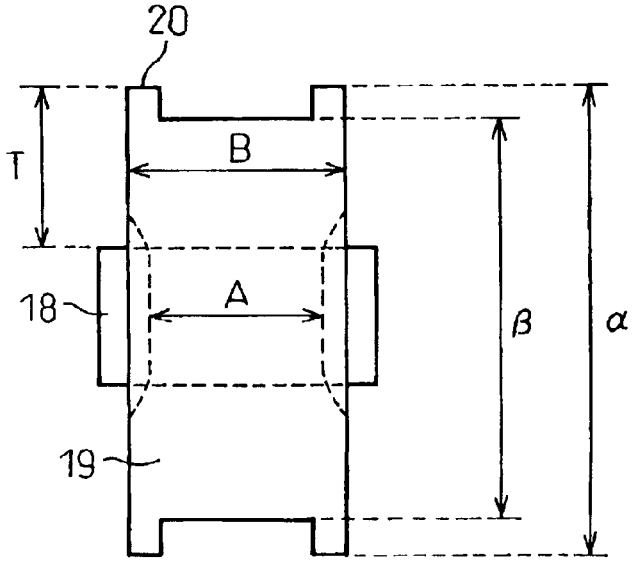
FIG. 2 is a schematic illustration of one example of a package having a high-selvage portion; wherein reference numerals are as follows.

A winding diameter $\alpha$ of the selvage portion and that $\beta$ of the central portion shown in FIG. 2 are measured, from which the difference in winding diameter was obtained by the following formula:

$$\text{Difference in winding diameter (mm)}=\alpha-\beta$$

(3) Bulging Percentage

A winding width A of the innermost yarn layer of the package and that B of a yarn layer at a winding thickness T/2 when a total winding thickness is T shown in FIG. 2 are measured, from which the bulging percentage was obtained by the following formula:

$$\text{Bulging percentage (\%)}=[(B-A)/A]\times 100$$

(4) Winding Hardness

By using a hardness tester (GC type-A) available from Techrock K.K., hardness was measured in opposite selvage portions of the conjugate fiber package, respectively, at four points apart 90 degrees from each other in the circumferential direction, and the average value thereof was defined as the winding hardness. The hardness of the selvage portion was measured at a point distant 2 mm from the lateral end surface.

(5) Difference in Unwinding Tension

The unwinding tension was recorded on a chart while unwinding the conjugate fiber from the conjugate fiber package at a speed of 1000 m/min. The tension measurement was carried out by using a tension meter (MODEL-1500) available from EIKO SOKKI K.K.

The respective measurement was continued for 60 seconds, and the tension fluctuation was recorded on a chart, from which a fluctuation width (g) of the unwinding tension was read and divided by the yarn fineness (dtex) of the conjugate fiber to obtain the difference in unwinding tension.

(6) Elongation at Break

The elongation at break was measured in accordance with JIS-L-1013.

(7) Stress Value at 10% Elongation

The stress value at 10% elongation was measured in accordance with JIS-L-1013.

Stress-strain of the conjugate fiber was measured 100 times in the yarn length direction, from which the stress (cN) at 10% elongation was obtained. The maximum value and the minimum value in the measured values were read, from which the difference is obtained and divided by the yarn fineness (dtex) to result in the stress value at 10% elongation (cN/dtex).

(8) Heat Shrinkage Stress Value

A thermal stress measuring device (for example, KANEBO ENGINEERING K.K.; KE-2) was used to determine the heat shrinkage stress value.

The conjugate fiber was cut into a 20 cm long piece, opposite ends of which are fastened together to form a loop. This test piece is mounted to the measuring device and the heat shrinkage stress was measured under an initial load of 0.044 cN/dtex at a temperature-rising speed of 100° C./min. The variation of heat shrinkage stress in accordance with the temperature was recorded on a chart.

In the chart, a temperature at which the heat shrinkage stress appears; that is, a temperature at which the stress rises from a base line; was obtained and referred to as a heat shrinkage stress developing temperature. The heat shrinkage stress depicts a hill-like curve in a high temperature area. A peak stress value (cN) was read and the heat shrinkage stress value was obtained by the following formula:

$$\text{Heat shrinkage stress value } (cN/d\text{tex})=\{\text{peak stress value } (cN)/2\}/\{\text{yarn fineness } (d\text{tex})\}-\text{initial load } (cN/d\text{tex})$$

(9) Yarn Fineness Variation

The yarn fineness variation value chart (diagram mass) was obtained by the following method and U % was measured simultaneously therewith.

Measuring device: Evenness Tester (manufactured by Zellweger Uster Co,: Uster tester UT-3)

Measuring condition:

Yarn speed: 100 m/min

Tension force: 12.5%

Tension setting: 1.0

Entry pressure: 2.5 hp

Twist: Z; 1.5 T/m

Length of measured yarn: 250 m/min

Scale: corresponding to the yarn fineness variation

Yarn fineness variation value U %: the variation chart and the value on the chart are directly read.

Yarn fineness variation coefficient: A period analysis diagram (spectrogram mass; a periodicity chart of variance in yarn fineness variation CV) was obtained by using a yarn fineness variation period analyzing software belonging to the measuring device, from which a height of a projected signal; i.e., the variation coefficient was measured.

(10) Fiber-fiber Dynamic Friction Coefficient

The fiber of 690 m long was wound around a cylinder under a tension of approximately 15 g at a traverse angle of 15 degrees. Then, the same kind of fiber as before of 30.5 cm was hung over the cylinder while vertically crossing the cylinder axis. A load (g) corresponding to 0.04 times of a total yarn fineness of the fiber hung over the cylinder was fastened to one end of this fiber and a strain gauge was connected to the other end thereof. Next, the cylinder is made to rotate at a peripheral speed of 18 m/min and a tension was measured by the strain gauge. From the tension thus obtained, the fiber-fiber dynamic friction coefficient f was determined by the following formula:

$$f=(1/\pi)\times\ln(T2/T1)$$

wherein T1 is a weight (g) applied to the fiber, T2 is an average tension (g) of at least 25 measured values, ln is a natural logarithm and $\pi$ is the ratio of the circumference of a circle to its diameter. In this regard, the measurement is carried out at 25° C.

The measurement of the coefficient was carried out ten times on groups of fiber of 100 g weight, and the difference between maximum and minimum values in the yarn length direction was obtained.

(11) Stretching Elongation (Vc) Prior to Being Treated with Boiling Water

A hank was formed by winding the yarn around a reel having a circumferential length of 1.125 m ten times. A load of $2\times10^{-3}$ cN/dtex was immediately applied thereto, then after 30 seconds, a length (L1) of the hank was measured.

Then, the load of $2\times10^{-3}$ cN/dtex was removed and a new load of 0.18 cN/dtex was applied. A length (L2) of the hank was measured after 30 seconds.

The stretching elongation (Vc) was obtained by the following formula:

$$\text{Stretching elongation } (Vc)=[(L2-L1)/L1]\times 100$$

The measurement was repeated ten times and an average value was obtained.

(12) Stretching Elongation ($CE_2$)

A hank was formed by winding the yarn around a reel having a circumferential length of 1.125 m ten times, and heat-treated in a boiling water for 30 minutes under a load of $2\times10^{-3}$ cN/dtex. Then, the hank was dried by dry heat at 180° C. for 15 minutes under this load. After the treatment, the hank was maintained stationarily in a thermo-humidity static chamber defined by JIS-L-1013 a whole day and night under no load. Then, the hank was loaded with 0.18 cN/dtex for 30 seconds, and a length (L4) of the hank was measured. Then, the load of 0.18 cN/dtex was removed and a new load of $1\times10^{-3}$ cN/dtex was applied. After 5 minutes, a length (L3) of the hank was measured.

The stretching elongation was obtained from the following formula:

$$\text{Stretching elongation } (CE_2)=[(L4-L3)/L3]\times100$$

The measurement was repeated ten times and an average value was obtained.

(13) Crystallization Calorific Value

A heat flux type differential scanning calorimeter (DSC-50) manufactured by SHIMADZU SEISAKUSHO K.K. was used.

5 mg of the pre-oriented conjugate fiber to be measured was precisely weighed and the measurement of the differential scanning calorimetry (DSC) was carried out in a range from 25 to 100° C. at a temperature rising speed of 5° C./min. The crystallization calorific value was obtained by calculating an area of heat generation peaks developed in a region from 40 to 80° C. in the DSC chart by using a program belonging to the differential scanning calorimeter.

(14) Stretching Modulus of False-twist Textured Yarn

The measurement was carried out in accordance with JIS-L-1090 Method for Testing Stretchability (A).

(15) Elongation Recovery Speed

A hank was formed by winding the false-twist textured yarn around a reel having a circumferential length of 1.125 m ten times and treated it was with boiling water for 30 minutes under no load. The measurement was carried out thereon in accordance with JIS-L-1013 as follows:

The false-twist textured yarn treated with boiling water was left stationarily a day and a night under no load.

The false-twist textured yarn was stretched by a tensile tester until a stress reaches 0.15 cN/dtex and maintained in this state for 3 minutes. Then, the yarn was cut by scissors at a position directly above a lower nip point.

A shrinking speed of the false-twist textured yarn cut by the scissors was measured by using a high speed video camera (resolving power: 1/1000 sec) as follows. A millimeter scale rule was fixed in parallel to the false-twist textured yarn at a distance of 10 mm. The recovery of a front end of the cut yarn was taken by the video camera while focusing to the front end. The record of the video camera was played back to read the displacement (mm/msec) of the front end of the false-twist textured yarn, and the recovery speed (m/sec) was obtained.

(16) Package Temperature

A package temperature during the winding was measured by using a non-touch type thermometer (THERMOVIEWER: JTG-6200 TYPE) manufactured by NIPPON DENSHI (JEOL) K.K.

(17) Spinning Tension

By using a tension meter ROTHSCHILD Min Tens R-046, a tension T1 (cN) applied to the running fiber was measured at a position 10 cm beneath the finishing agent applicator nozzle (reference numeral 13 in FIGS. 11 and 12). The measured tension was divided by the fiber fineness D (dtex) to obtain a spinning tension.

$$\text{Spinning tension } (cN/d\text{tex})=T1/D$$

(18) Heat Treatment Tension

By using a tension meter ROTHSCHILD Min Tens R-046, a tension T2 (cN) applied to the running fiber during the heat treatment was measured at an exit of the hot godet roll (between the first godet roll 14 and the second godet roll 15 in FIG. 11). The measured tension was divided by the fiber fineness D (dtex) of the drawn fiber to obtain a heat treatment tension.

$$\text{Heat treatment tension } (cN/d\text{tex})=T2/D$$

(19) Drawing Tension

By using a tension meter ROTHSCHILD Min Tens R-046, a tension T3 (cN) applied to the running fiber during the drawing was measured at a position between a supply roll and a heat-treatment device (between the first godet roll 14 and the second godet roll 15 in FIG. 12). The measured tension was divided by the fiber fineness D (dtex) of the drawn fiber to obtain a heat treatment tension.

$$\text{Drawing tension (cN/dtex)}=T3/D$$

(20) Fluctuation in Unwinding Tension

An unwinding tension was recorded on a chart while unwinding the conjugate fiber from a conjugate fiber package at a speed of 1000 m/min.

A tension meter (MODEL 1500) manufactured by EIKO SOKKI K.K. was used for the tension measurement.

Each measurement lasted for 60 seconds and was recorded on a chart. From this chart, a width (g) of the fluctuation of unwinding tension was read and divided by a fiber fineness (dtex) of the conjugate fiber to obtain a difference in unwinding tension.

(21) Unwinding Property and False Twisting Ability

The false-twist texturing was carried out under the following condition, in which the number of yarn breakage per day was obtained when the false-twist texturing is continuously carried out by a false-twisting machine of 96 spindle/machine.

False-twist texturing machine: 33H type machine (a belt type) manufactured by MURATA KIKAI SEISAKUSHO K.K.

False-twisting condition:

Yarn speed: 500 m/min

Number of false-twist: 3230 T/m

First feed ratio: −1%

Temperature of first heater: 170° C.

1) Unwinding Property

The number of yarn breakage occurring between the drawn pirn to an entrance of the feed roller was counted, based on which the judgement was made in accordance with the following criteria:

◎: the yarn breakage is less than 10 times/day per machine; very good.

○: the yarn breakage is in a range from 10 to 30 times/day per machine; good.

x: the yarn breakage exceeds 30 times/day per machine whereby the industrial production was difficult.

2) False Twisting Ability

The number of yarn breakage occurring in the heater after feed roll was counted, based on which the judgement was made in accordance with the following criteria:

◎: the yarn breakage is less than 10 times/day per machine; very good.

○: the yarn breakage is in a range from 10 to 30 times/day per machine; good.

x: the yarn breakage exceeds 30 times/day per machine whereby the industrial production was difficult.

(22) Dyeing Appearance Quality

A plain weave fabric was prepared by using the PTT drawn yarn (manufactured by ASAHI KASEI K.K.; "Solo") of 56 dtex/24 f as warp yarns arranged at a warp density of 72 reed/2 and the polyester type conjugate fiber as weft yarns at a weft density of 80 end/2.54 cm, and scoured and dyed in a normal manner. The appearance quality of the resultant fabric was determined by an expert in accordance with the following criteria:

◎: very good because there is no periodic dyeing unevenness.

○: good because there is no periodic dyeing unevenness.

x: no good because there is a periodic dyeing unevenness or streak.

(23) Spinning Stability

The melt-spinning and drawing were carried out for two days in each of Examples by using a melt-spinning machine having a spinneret of four ends per spindle.

From the number of yarn breakage times in this period and the generation frequency of fluffs existing in the resultant drawn yarn package (a ratio of the number of packages in which the fluff was generated), the spinning stability was determined in accordance with the following criteria:

◎: the yarn breakage was not occur at all and the ratio of a number of packages having fluffs was 5% or less.

○: the yarn breakage was two times or less and the ratio of fluff generating package was less than 10%.

x: the yarn breakage was three times or more and the ratio of fluff generating package was 10% or more.

(24) Total Estimation

All of the unwinding property, processability and dyeing appearance quality were determined in accordance with the following criteria:

◎: all of the unwinding property, processability and dyeing appearance quality were very good.

○: the unwinding property, processability and dyeing appearance quality were good, or at least one of them was very good.

x: at least one of the unwinding property, processability and dyeing appearance quality was no good.

EXAMPLES 1 to 5

In these Examples, the production of the polyester type pre-oriented conjugate fiber package will be described. That is, the effect of the heat treatment conditions on the physical property of the pre-oriented conjugate fiber and the package shape will be described.

A PTT type pre-oriented conjugate fiber of 70 dtex/24 filaments was produced by using the spinning machine and the winder shown in FIG. 11 from PTT pellets having an intrinsic viscosity of 1.2 dl/g and containing titanium oxide of 0.4 wt % as one component and PTT pellets having an intrinsic viscosity of 0.92 dl/g and containing titanium oxide of 0.4 wt % as another component.

The spinning conditions were as follows:

Pellet drying temperature and final moisture content: 110° C., 15 ppm

Extruder temperature: shaft A: 255° C. and shaft B: 250° C.

Spin head temperature: 265° C.

Diameter of spinning orifice: 0.35 mm ϕ

Length of spinning orifice: 1.05 mm (L/D=3)

Inclination angle of spinning orifice θ: 35 degrees

Cooling air: temperature of 22° C., relative humidity of 90%, speed of 0.5 m/sec Finishing agent: aqueous emulsion mainly consisting of polyether ester (a concentration of 10 wt %)

Distance from spinneret to finishing agent applicator nozzle: 75 cm

Spinning tension: 0.13 cN/dtex (Winding Condition)

First godet roll: speed of 2300 m/min; temperature is described in Table 1.

Second godet roll: speed of 2420 m/min; non-heated

Winder: AW-909 manufactured by TEIJIN SEIKI K.K. (both shafts of a bobbin and a contact roll are self-driven)

Winding speed: 2420 m/min

Temperature of winding package: 25° C.

Figure 1:
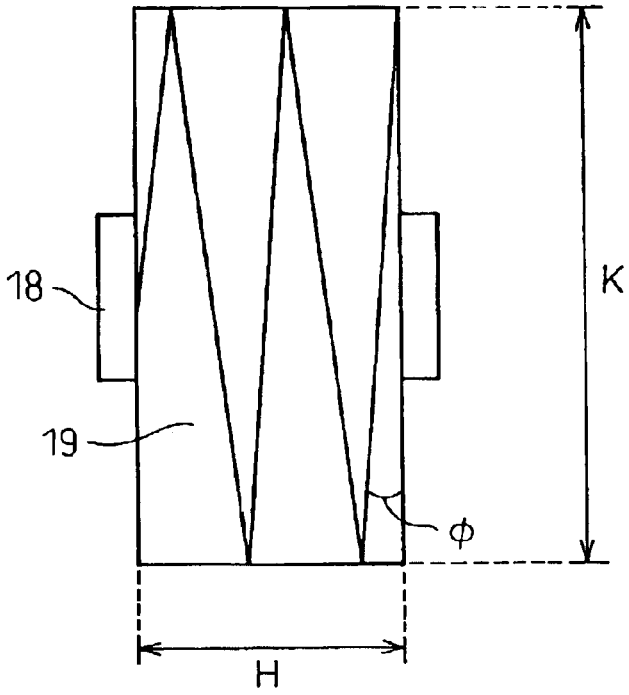
FIG. 1 is a schematic illustration of one example of a package having no high-selvage portion.

The winding was carried out while changing the temperature of the first godet roll as shown in FIG. 1. The shape of the package and the physical property of the PTT type pre-oriented conjugate fiber were as follows:

(Pre-oriented Conjugate Fiber Package)

Moisture content: 0.6 wt %

Winding diameter: 310 mm

Winding width: 100 mm

Yarn length between a selvage portion to the opposite portion: 90 cm

Winding weight: 5.2 kg/bobbin (Physical Property of Pre-oriented Conjugate Fiber)

Average intrinsic viscosity [η]: 1.02

Fiber fineness: 69.4 dtex

Strength: 1.7 cN/dtex

Elongation: as described in Table 1

Fiber-fiber dynamic friction coefficient: 0.28

Difference in coefficient of dynamic friction in the yarn length direction between maximum and minimum values: 0.03

Difference in stress at 10% elongation between maximum and minimum values: 0.11 cN/dtex Degree of intermingling: 4 points/m (Physical Property of False-twist Textured Yarn)

Yarn fineness: 56.0 dtex

Strength: as described in Table 1

Elongation: 36%

Stretching elongation: 300%

Stretching elongation $CE_2$ under 2 mg load: as described in Table 1

Stretching recovery speed: 29 m/sec

The difference in unwinding tension in Table 1 was measured at an unwinding speed of 1000 m/min.

The dyeing appearance quality of woven fabrics obtained by using, as weft yarns, the false-twist textured yarns resulted from the conjugate fiber packages produced by these Examples was shown in Table 1. As apparent from Table 1, the resultant woven fabric was free from a periodic drawback caused by the selvage portion of the package and excellent in dyeing uniformity as well as had a high stretching elongation and stretch-back property.

EXAMPLES 6 TO 10 AND COMPARATIVE EXAMPLES 1 AND 2

In these Examples, the effect of the winding speed in the winding condition on the production of PTT type pre-oriented conjugate fiber package will be described.

These Examples were carried out in the same manner as in Example 1 except for conditions shown in Table 2. The heat treatment was carried out under the condition that the first godet roll was heated at 80° C. and the second godet roll was non-heated; and the heat-treatment tension (between the first and second godet rolls in these Examples) is 0.04 cN/dtex. A PTT type pre-oriented conjugate fiber package having the same package size as in Example 1 was produced while changing the winding speed as shown in Table 2. In these Examples and Comparative examples, the temperature of the package during winding up was maintained at 25° C.

The obtained package of PTT type pre-oriented conjugate fiber was stored for 30 days at 25° C., and thereafter subjected to the draw false-twist texturing process.

The dyeing appearance quality of the textured yarns is shown in Table 2. The difference in unwinding tension shown in Table 2 was measured at an unwinding speed of 1000 m/min.

As is apparent from Table 2, the woven fabric of the false-twist textured yarn obtained from the PTT type pre-oriented conjugate fiber package according to the present invention was free from a periodic dyeing unevenness as well as had a high stretching elongation and stretch-back property.

EXAMPLES 11 TO 13 AND COMPARATIVE EXAMPLE 3

In these Examples, the effect of the package temperature during the winding on the production of PTT type pre-oriented conjugate fiber package will be described.

These Examples were carried out in the same manner as in Example 2 except that the cooling condition of the winding PTT type pre-oriented conjugate fiber package was changed as shown in Table 3.

The shape of the resultant PTT type pre-oriented conjugate fiber package and the physical property of the pre-oriented conjugate fiber are shown in Table 3. The difference in unwinding tension shown in Table 3 was measured at an unwinding speed of 1000 m/min.

As apparent from Table 3, the pre-oriented conjugate fiber package wound at a temperature range of the present invention was excellent in winding form and a woven fabric obtained therefrom was good in appearance quality.

EXAMPLES 14 TO 16 AND COMPARATIVE EXAMPLE 4

In these Examples, the effect of the spinning tension on the production of a PTT type pre-oriented conjugate fiber package will be described.

These Examples were carried out in the same manner as in Example 2 except that the distance of the finishing agent applicator nozzle from the spinneret was changed as shown in Table 4 to obtain the PTT type pre-oriented conjugate fiber package.

The spinnability is shown in Table 4. The difference in unwinding tension in Table 4 was measured at the unwinding speed of 1000 m/min.

As is apparent from Table 4, when the spinning tension was within the range defined by the present invention, the spinnability became good and a false-twist textured yarn excellent in appearance quality was obtained.

EXAMPLES 17 TO 21 AND COMPARATIVE EXAMPLES 5 AND 6

In these Examples, the effect of the winding speed on the false twisting ability and the appearance quality of the textured yarn, when the PTT pre-oriented conjugate fiber was wound without being heat-treated during the winding in the production of the PTT pre-oriented conjugate fiber package, will be described. Further, the effect of the storage condition of the PTT pre-oriented conjugate fiber package will be described.

The PTT type pre-oriented conjugate fiber of 71 dtex/24 filaments was produced by using the spinning machine and the winder shown in FIG. 11 while changing a winding speed as shown in Table 5 from PTT pellets having an intrinsic viscosity of 1.25 dl/g and containing titanium oxide of 0.4 wt % as one component and PTT pellets having an intrinsic viscosity of 0.92 dl/g and containing titanium oxide of 0.4 wt % as another component.

(Spinning Condition)

Pellet drying temperature and final moisture content: 110° C., 15 ppm

Extruder temperature: shaft A: 255° C. and shaft B: 250° C.

Spin head temperature: 265° C.

Diameter of spinning orifice: 0.50 mm $\phi$

Length of spinning orifice: 1.25 mm

Inclination angle $\theta$ of spinning orifice: 35 degrees

Cooling air: temperature of 22° C., relative humidity of 90%, speed of 0.5 m/sec Finishing agent: aqueous emulsion mainly consisting of polyether ester (a concentration of 10 wt %)

Distance from spinneret to finishing agent applicator nozzle: 75 cm (Winding Condition)

Winder: AW-909 manufactured by TEIJIN SEIKI K.K. (the shafts of both a bobbin and a contact roll are self-driven)

Temperature of winding package: 20° C. (measured by a non-touch type thermometer)

(Pre-oriented Conjugate Fiber Package)

Moisture content: 0.6 wt %

Winding diameter: 31 cm

Winding width: 19.3 cm

Yarn length between one selvage portion to another: 90 cm

Winding weight: 5.2 kg/bobbin (Physical Property of Pre-oriented Conjugate Fiber)

Fiber-fiber dynamic friction coefficient: 0.26

Difference in coefficient of dynamic friction in the yarn length direction between maximum and minimum values: 0.04

Difference in stress at 10% elongation between maximum and minimum values: 0.09 cN/dtex Degree of intermingling: 9 points/m After the wound pre-oriented conjugate fiber package has been maintained in an environment at 20° C. and at 90% RH of relative humidity for 5 days until being subjected to the draw false-twist texturing process.

A shape of the pre-oriented conjugate fiber package, the yarn fineness variation value of the yarn unwound from the package, the false twisting ability and the dyeing appearance quality of the textured yarn are shown in Table. 5. The difference in unwinding tension in Table 5 was measured at the unwinding speed of 1000 m/min.

As apparent from Table 5, the PTT type pre-oriented conjugate fiber packages obtained in Examples 17 to 21 of the present invention were excellent in draw false twisting ability and the textured yarns were good in dyeing appearance quality.

The physical property of the false-twist textured yarn obtained by draw false-twist texturing the yarn in the pre-oriented conjugate fiber package is shown as follows:

(Physical Property of False-twist Textured Yarn)

Yarn fineness: 56.6 dtex

Tensile strength: as shown in Table 5

Elongation at break: 38%

Stretching elongation: 243%

Stretching elongation $CE_2$ under 2 mg load: as shown in Table 5

The false-twist textured yarn had a high stretching elongation. Either of the instantaneous recovery speeds of the false-twist textured yarns in Examples 17 to 21 was 20 m/sec or more, and the woven fabric was excellent in dyeing appearance quality and stretch-back property.

EXAMPLES 22 TO 30 AND COMPARATIVE EXAMPLES 7 TO 9

In these Examples, the effect of the temperature and the time, for maintaining a PTT type pre-oriented conjugate fiber package wherein the yarn was wound without being heat-treated during the winding, and until the false-twist texturing was carried out, will be described.

The PTT pre-oriented conjugate fiber package was obtained in accordance with the same spinning and winding conditions as in Example 19 (in which the winding speed was 2400 m/min).

The PTT pre-oriented conjugate fiber package thus obtained was maintained in the conditions shown in Table 6 and false-twist textured.

The shape of the PTT pre-oriented conjugate fiber package and the yarn fineness variation value measured while being unwound from the package during the false-twist texturing process as well as the false twisting ability and the dyeing appearance quality are shown in Table 6.

As apparent from Table 6, when the yarn was draw false-twist textured after being maintained within a temperature range defined by the present invention, the yarn had a favorable false twisting ability and the false-twist textured yarn was excellent in dyeing appearance quality.

EXAMPLES 31 TO 35 AND COMPARATIVE EXAMPLES 10 AND 11

In these Examples, the effect of a ratio $V_W/V_R$ between the speed $V_R$ of the hot second godet roll and the winding speed $V_W$ on the production of the polyester type drawn conjugate fiber package will be described.

A package of PTT type drawn conjugate fiber of 84 dtex/24 filaments was produced from PTT pellets having the intrinsic viscosity of 1.26 dl/g containing titanium oxide of 0.4 wt % as one component and PTT pellets having the intrinsic viscosity of 0.92 dl/g containing titanium oxide of 0.4 wt % as another component by using a spinning machine and a winder having three pairs of godet rolls as shown in FIG. 12. The spinning conditions in these Examples was as follows:

(Spinning Conditions)

Pellet drying temperature and final moisture content: 110° C., 15 ppm

Extruder temperature: shaft A 255° C., shaft B 250° C.

Spin head temperature: 265° C.

Diameter of spinning orifice: 0.50 mm $\phi$

Length of spinning orifice: 1.25 mm

Inclination angle $\theta$ of spinning orifice: 35 degrees

Cooling air: temperature 22° C., relative humidity 90%, speed 0.5 m/sec

Finishing agent: aqueous emulsion of fatty acid ester of 60 wt %, polyether of 5 wt %, nonionic surfactant of 30 wt % and antistatic agent of 5 wt % (concentration of 10 wt %)

Distance from spinneret to finishing agent applicator nozzle: 90 cm

Spinning tension: 0.08 cN/dtex (Winding Condition)

First godet roll: speed 1500 m/min, temperature 55° C.

Second godet roll: temperature 120° C.

Third godet roll: non-heated

Winder: AW-909 manufactured by TEIJIN SEIKI K.K. (both of a bobbin shaft and a contact roll are self-driven)

Traverse angle:
winding thickness from 0 to 5 mm: 3.5 degrees
winding thickness from 5 to 70 mm: 6.5 degrees
winding thickness from 70 to 110 mm: 4.0 degrees Winding tension: 0.05 cN/dtex Package temperature during the winding: 25° C.

The winding was carried out while changing the speed $V_R$ of the second godet roll as shown in Table 7 so that the drawing tension varies.

The shape of the package and the physical property of the resultant PTT drawn conjugate fiber were as follows:

(Conjugate Fiber Package)

Moisture content: 0.6 wt %

Winding diameter: 330 mm

Outer diameter of paper tube: 110 mm

Winding width: 90 mm

Winding weight: 5.2 kg/bobbin (Physical Property of Fiber)

Yarn fineness: 83.5 dtex

Average intrinsic viscosity of yarn [$\eta$]: 0.96 dl/g

Degree of intermingling: 7 points/m

Fiber-fiber dynamic friction coefficient: 0.27

Difference in coefficient of dynamic friction in the yarn length direction between maximum and minimum values: 0.03

Difference in stress at 10% elongation between maximum and minimum values: 0.14 cN/dtex The drawn conjugate fiber package thus wound was maintained in an environment at 30° C. and at 90% RH of relative humidity for 30 days.

The unwinding property of the resultant drawn conjugate fiber package and the physical property of the drawn conjugate fiber are shown in Table 7. The difference in unwinding tension in Table 7 was measured at the unwinding speed of 1000 m/min. A chart of the fluctuation in unwinding tension of the drawn conjugate fiber package obtained in Example 32 at an unwinding tension of 1000 m/min was shown in FIG. 7.

As apparent from Table 7, if the difference in dry heat shrinkage stress value of the drawn conjugate fiber and the difference in unwinding tension were within a range defined by the present invention, the package was excellent in unwinding property and the resultant fabric was good in dyeing appearance quality.

In Comparative example 10, the spinnability was worse because the drawing tension was low and the resultant fabric was inferior in dyeing appearance quality.

In Comparative example 11, many fluffs were generated due to high drawing tension. The resultant drawn conjugate fiber package had a high-selvage portion to deteriorate the unwinding property at a high speed and the fabric was inferior in dyeing appearance quality.

The drawn conjugate fiber in Example 33 was false-twist textured by a 33H type false-twist texturing machine manufactured by MURATA KIKAI Co.

(False-twist Texturing Condition)

Hi heater temperature: 170° C.

Twister angle: 110 degrees

Draw ratio: 1.16

Processing speed: 300 m/min (Physical Property of False-twist Textured Yarn)

Yarn fineness: 71.0 dtex

Strength: 2.1 cN/dtex

Elongation: 36%

Stretching elongation: 290%

Stretching elongation under 2 mg load: 170%

Elongation recovery speed: 25 m/sec

The draw false-twist textured yarn obtained by using the PTT type drawn conjugate fiber package of the present invention was excellent-in dyeing appearance quality and had a high stretching elongation and stretch-back ability.

EXAMPLES 36 TO 41 AND COMPARATIVE EXAMPLE 12

In these Examples, the effect of a ratio $V_W/V_R$ between the speed $V_R$ of hot second godet roll and the winding speed $V_W$ and the heat treatment under tension between the hot second and third godet rolls on the production of the PTT type drawn conjugate fiber package will be described.

The drawn conjugate fiber package was obtained by the direct draw spinning in the same manner as in Example 31 except that the winding speed $V_W$ is changed as shown in Table 8.

The winding condition is as follows:

(Winding condition)

First godet roll: speed 2000 m/min, temperature 55° C.

Second godet roll: speed 3045 m/min

Draw ratio: 1.52

Drawing tension: 0.25 cN/dtex

Second godet roll: temperature 120° C.

Speed ratio between second and third godet rolls: as shown in Table 8

Third godet roll: temperature as shown in Table 8

The difference in unwinding tension in Table 8 was measured at the unwinding speed of 1000 m/min.

As apparent from Table 8, if the ratio of $V_W/V_R$ was within the range defined by the present invention, a good drawn conjugate fiber package and a resultant fabric excellent in appearance quality, were obtained. Further, when the drawn conjugate fiber was heat-treated by heating the third godet roll, the stretching elongation $CE_2$ became 20% or more to develop favorable crimpability.

In Comparative example 12, the heat treatment was carried out at the speed ratio (the third godet roll/the second godet roll) of 0.98 which was a relaxed heat treatment, and the winding was somewhat unstable because there was yarn breakage during the winding.

EXAMPLES 42 TO 44 AND COMPARATIVE EXAMPLES 13 AND 14

In these Examples, the effect of the winding width of the conjugate fiber package will be described.

The conjugate fiber packages shown in Table 9 were obtained by the melt-spinning and the continuous drawing in the same manner as in Example 33, while differentiating the traverse width of the winder during the winding.

The winding weight and the shape of the conjugate fiber package and the appearance quality of the resultant fabric are shown in Table 9. The difference in unwinding tension in Table 9 was measured at the unwinding speed of 1000 m/min. A chart of the fluctuation of unwinding tension is shown in FIG. 8 when the yarn was unwound from the conjugate fiber package obtained in Comparative example 14.

As is apparent from FIG. 8, when the winding width of the package was out of the range of the present invention, the tension fluctuation was large at a high unwinding speed to deteriorate the unwinding property.

As apparent from Table 9, if the winding width and the winding diameter of the conjugate fiber package were within the range of the present invention, the unwinding property was good and a fabric excellent in appearance quality was resulted.

For the purpose of showing the effect of the winding width of the conjugate fiber package on the unwinding property, the differences in unwinding tension at various unwinding speeds are shown in Table 10, concerning the package obtained in Example 32 and Comparative example 14. As is apparent from Table 10, the conjugate fiber package of the present invention was excellent in unwinding property.

EXAMPLE 45

In this Example, the effect obtained by changing the traverse angle in accordance with the winding diameter will be described.

The melt-spinning and drawing were carried out in the same manner as in Example 33 while changing the traverse angle in accordance with the winding diameter as follows:

Traverse angle:

winding thickness from 0 to 10 mm: 4 degrees winding thickness from 10 to 70 mm: 7 degrees winding thickness from 70 to 110 mm: 4 degrees The resultant conjugate fiber package had the difference in diameter of 3 mm and the difference in unwinding tension was as small as 0.002 cN/dtex, resulting in good unwinding property and dyeing appearance quality.

EXAMPLES 46 AND 47 AND COMPARATIVE EXAMPLE 15

In these Examples, the effect obtained by kinds of polyester component used together with PTT as the other component will be described.

By changing the kinds of polyester as the other component, the conjugate fibers were obtained as shown in Table 11.

The physical properties of the conjugate fiber packages thus obtained are shown in Table 11. The difference in unwinding tension in Table 11 was measured at the unwinding speed of 1000 m/min.

As is apparent in Table 11, even if PET or PBT was used as the other component, a good unwinding property and dyeing appearance quality were obtained.

In Comparative example 15 in which PET was used for both the components, the stretching elongation $CE_2$ of the drawn conjugate fiber and the stretching elongation $CE_2$ of the false-twist textured yarn were low which showed the inferiority of the crimpability.

TABLE 1

| | Example 1 | Example 2 | Example 3 | Example 4 | Example 5 |
|---|---|---|---|---|---|
| First godet roll temperature (° C.) | 80 | 90 | 100 | 110 | 120 |
| Heat-treatment tension (cN/dtex) | 0.07 | 0.06 | 0.05 | 0.04 | 0.03 |
| Spinning stability | ◎ | ◎ | ◎ | ◎ | ○ |
| Difference in winding diameter (mm) | 7 | 5 | 4 | 4 | 4 |
| Difference in dry heat shrinkage stress value (cN/dtex) | 0.004 | 0.004 | 0.003 | 0.002 | 0.002 |
| Yarn fineness variation value U % (%) | 1.1 | 1.0 | 1.0 | 1.1 | 0.9 |
| Yarn fineness variation coefficient | 0.4 | 0.2 | 0.2 | 0.2 | 0.3 |
| Difference in unwinding tension ΔF (cN/dtex) | 0.002 | 0.002 | 0.003 | 0.002 | 0.003 |
| Bulging percentage (%) | 8 | 8 | 7 | 7 | 6 |
| Stretching elongation of selvage fiber Vc (%) | 0 | 0 | 1 | 1 | 1 |
| Selvage hardness | 76 | 75 | 76 | 76 | 76 |
| Difference in hardness between opposite selvages | 4 | 5 | 4 | 4 | 2 |
| Winding density ($cm^3$/g) | 0.87 | 0.88 | 0.87 | 0.87 | 0.86 |
| Stretching elongation Vc (%) | 2 | 2 | 1 | 1 | 0 |
| Elongation at break (%) | 78 | 77 | 76 | 76 | 75 |
| Dry heat shrinkage stress value (cN/dtex) | 0.05 | 0.04 | 0.04 | 0.03 | 0.03 |
| Crystallization calorific value (J/g) | 5 | 3 | 0 | 0 | 0 |
| Tensile strength of false-twist textured yarn (cN/dtex) | 2.3 | 2.2 | 2.2 | 2.2 | 2.2 |
| Stretching elongation of false-twist textured yarn $CE_2$ (%) | 150 | 155 | 155 | 150 | 150 |
| Unwinding property | ◎ | ◎ | ◎ | ◎ | ◎ |
| False-twisting ability | ◎ | ◎ | ◎ | ◎ | ◎ |
| Dyeing appearance quality | ◎ | ◎ | ◎ | ◎ | ○ |
| Total estimation | ◎ | ◎ | ◎ | ◎ | ○ |

TABLE 2

| | Comparative example 1 | Example 6 | Example 7 | Example 8 | Example 9 | Example 10 | Comparative example 2 |
|---|---|---|---|---|---|---|---|
| Winding speed (m/min) | 1300 | 1700 | 2000 | 2500 | 2800 | 3400 | 4200 |
| Spinning tension (cN/dtex) | 0.08 | 0.11 | 0.13 | 0.16 | 0.19 | 0.25 | 0.33 |
| Spinning stability | ○ | ◎ | ◎ | ◎ | ◎ | ○ | X |
| Difference in winding diameter (mm) | 12 | 7 | 4 | 3 | 5 | 8 | 12 |
| Difference in dry heat shrinkage stress value (cN/dtex) | 0.014 | 0.009 | 0.004 | 0.004 | 0.005 | 0.008 | 0.021 |

TABLE 2-continued

| | Comparative example 1 | Example 6 | Example 7 | Example 8 | Example 9 | Example 10 | Comparative example 2 |
|---|---|---|---|---|---|---|---|
| Yarn fineness variation value U % (%) | 1.7 | 1.2 | 1.0 | 1.1 | 1.1 | 1.3 | 1.9 |
| Yarn fineness variation coefficient | 0.9 | 0.4 | 0.2 | 0.2 | 0.2 | 0.4 | 0.9 |
| Difference in unwinding tension ΔF (cN/dtex) | 0.002 | 0.002 | 0.002 | 0.002 | 0.003 | 0.005 | 0.011 |
| Bulging percentage (%) | 4 | 4 | 5 | 6 | 7 | 9 | 13 |
| Stretching elongation of selvage fiber Vc (%) | 0 | 0 | 0 | 1 | 1 | 3 | 5 |
| Selvage hardness | 70 | 71 | 73 | 76 | 80 | 88 | 92 |
| Difference in hardness between opposite selvages | 2 | 2 | 4 | 6 | 6 | 9 | 13 |
| Winding density ($cm^3/g$) | 0.82 | 0.83 | 0.84 | 0.86 | 0.86 | 0.90 | 0.93 |
| Stretching elongation Vc (%) | 0 | 0 | 1 | 1 | 1 | 2 | 2 |
| Elongation at break (%) | 140 | 110 | 97 | 81 | 72 | 62 | 49 |
| Dry heat shrinkage stress value (cN/dtex) | 0.02 | 0.03 | 0.03 | 0.05 | 0.06 | 0.08 | 0.18 |
| Crystallization calorific value (J/g) | 13 | 10 | 8 | 4 | 0 | 0 | 0 |
| Tensile strength of false-twist textured yarn (cN/dtex) | 2.5 | 2.4 | 2.4 | 2.4 | 2.3 | 2.3 | 2.2 |
| Stretching elongation of false-twist textured yarn $CE_2$ (%) | 155 | 153 | 155 | 150 | 155 | 154 | 153 |
| Unwinding property | ◎ | ◎ | ◎ | ◎ | ◎ | ◎ | X |
| False-twisting ability | X | ○ | ◎ | ◎ | ◎ | ◎ | ○ |
| Dyeing appearance quality | X | ○ | ◎ | ◎ | ◎ | ○ | X |
| Total estimation | X | ○ | ◎ | ◎ | ◎ | ○ | X |

TABLE 3

| | Example 11 | Example 12 | Example 13 | Comparative example 3 |
|---|---|---|---|---|
| Package temperature (° C.) | 20 | 26 | 30 | 43 |
| Spinning stability | ◎ | ◎ | ◎ | X |
| Difference in winding diameter (mm) | 3 | 4 | 6 | 14 |
| Difference in dry heat shrinkage stress value (cN/dtex) | 0.001 | 0.002 | 0.007 | 0.013 |
| Yarn fineness variation value U % (%) | 0.9 | 1.0 | 1.3 | 1.4 |
| Yarn fineness variation coefficient | 0.2 | 0.2 | 0.4 | 1.0 |
| Difference in unwinding tension ΔF (cN/dtex) | 0.002 | 0.004 | 0.006 | 0.010 |
| Bulging percentage (%) | 6 | 8 | 9 | 16 |
| Stretching elongation of selvage fiber Vc (%) | 0 | 0 | 1 | 3 |
| Selvage hardness | 75 | 78 | 84 | 92 |
| Difference in hardness between opposite selvages | 2 | 4 | 7 | 11 |
| Winding density ($cm^3/g$) | 0.84 | 0.88 | 0.90 | 0.94 |
| Tensile strength of false-twist textured yarn (cN/dtex) | 2.4 | 2.4 | 2.4 | 2.4 |

TABLE 3-continued

| | Example 11 | Example 12 | Example 13 | Comparative example 3 |
|---|---|---|---|---|
| Stretching elongation of false-twist textured yarn $CE_2$ (%) | 152 | 155 | 155 | 150 |
| Unwinding property | ◎ | ◎ | ○ | X |
| False-twisting ability | ◎ | ◎ | ○ | ○ |
| Dyeing appearance quality | ◎ | ◎ | ○ | X |
| Total estimation | ◎ | ◎ | ○ | X |

TABLE 4

| | Example 14 | Example 15 | Example 16 | Comparative example 4 |
|---|---|---|---|---|
| Finishing agent applicator nozzle position (cm) | 60 | 90 | 120 | 150 |
| Spinning tension (cN/dtex) | 0.11 | 0.16 | 0.22 | 0.35 |
| Spinning stability | ◎ | ◎ | ○ | X |
| Difference in winding diameter (mm) | 4 | 5 | 8 | 15 |
| Difference in dry heat shrinkage stress value (cN/dtex) | 0.004 | 0.005 | 0.008 | 0.015 |
| Yarn fineness variation value U % (%) | 0.9 | 1.0 | 1.1 | 1.6 |
| Yarn fineness variation coefficient | 0.2 | 0.2 | 0.2 | 0.6 |
| Difference in unwinding tension ΔF (cN/dtex) | 0.002 | 0.002 | 0.003 | 0.004 |
| Bulging percentage (%) | 7 | 7 | 8 | 14 |
| Stretching elongation of selvage fiber Vc (%) | 0 | 0 | 1 | 3 |
| Selvage hardness | 70 | 78 | 85 | 92 |
| Difference in hardness between opposite selvages | 2 | 3 | 5 | 11 |
| Winding density ($cm^3/g$) | 0.86 | 0.88 | 0.90 | 0.93 |
| Stretching elongation Vc (%) | 0 | 0 | 1 | 2 |
| Dry heat shrinkage stress value (cN/dtex) | 0.04 | 0.05 | 0.07 | 0.08 |
| Tensile strength of false-twist textured yarn (cN/dtex) | 2.4 | 2.5 | 2.5 | 2.6 |
| Stretching elongation of false-twist textured yarn $CE_2$ (%) | 160 | 160 | 165 | 160 |
| Unwinding property | ◎ | ◎ | ○ | X |
| False-twisting ability | ◎ | ◎ | ◎ | ○ |
| Dyeing appearance quality | ◎ | ◎ | ○ | X |
| Total estimation | ◎ | ◎ | ○ | X |

TABLE 5

| | Comparative example 5 | Example 17 | Example 18 | Example 19 | Example 20 | Example 21 | Comparative example 6 |
|---|---|---|---|---|---|---|---|
| Winding speed (m/min) | 1400 | 1800 | 2200 | 2400 | 2900 | 3300 | 4300 |
| Spinning tension (cN/dtex) | 0.09 | 0.12 | 0.14 | 0.15 | 0.20 | 0.23 | 0.34 |
| Spinning stability | ◎ | ◎ | ◎ | ◎ | ◎ | ○ | X |

TABLE 5-continued

| | Comparative example 5 | Example 17 | Example 18 | Example 19 | Example 20 | Example 21 | Comparative example 6 |
|---|---|---|---|---|---|---|---|
| Difference in winding diameter (mm) | 11 | 6 | 3 | 2 | 5 | 7 | 13 |
| Difference in dry heat shrinkage stress value (cN/dtex) | 0.012 | 0.008 | 0.004 | 0.005 | 0.005 | 0.008 | 0.022 |
| Yarn fineness variation value U % (%) | 1.6 | 1.1 | 0.9 | 0.9 | 1.0 | 1.3 | 1.7 |
| Yarn fineness variation coefficient | 0.6 | 0.3 | 0.2 | 0.2 | 0.2 | 0.3 | 0.9 |
| Difference in unwinding tension ΔF (cN/dtex) | 0.001 | 0.002 | 0.003 | 0.003 | 0.004 | 0.006 | 0.011 |
| Bulging percentage (%) | 6 | 7 | 8 | 8 | 9 | 9 | 14 |
| Stretching elongation of selvage fiber Vc (%) | 0 | 0 | 0 | 1 | 3 | 14 | 23 |
| Selvage hardness | 68 | 72 | 74 | 78 | 83 | 88 | 93 |
| Difference in hardness between opposite selvages | 1 | 2 | 4 | 4 | 5 | 8 | 12 |
| Winding density ($cm^3/g$) | 0.83 | 0.84 | 0.84 | 0.86 | 0.87 | 0.90 | 0.93 |
| Stretching elongation Vc (%) | 0 | 0 | 0 | 1 | 1 | 2 | 3 |
| Elongation at break (%) | 130 | 105 | 90 | 84 | 70 | 64 | 46 |
| Dry heat shrinkage stress value (cN/dtex) | 0.01 | 0.02 | 0.03 | 0.04 | 0.05 | 0.06 | 0.09 |
| Crystallization calorific value (J/g) | 17 | 15 | 14 | 13 | 12 | 12 | 11 |
| Tensile strength of false-twist textured yarn (cN/dtex) | 2.5 | 2.5 | 2.4 | 2.5 | 2.5 | 2.4 | 2.4 |
| Stretching elongation of false-twist textured yarn $CE_2$ (%) | 162 | 158 | 156 | 156 | 154 | 154 | 144 |
| Unwinding property | ◎ | ◎ | ◎ | ◎ | ◎ | ○ | X |
| False-twisting ability | ◎ | ◎ | ◎ | ◎ | ◎ | ◎ | ○ |
| Dyeing appearance quality | X | ○ | ◎ | ◎ | ◎ | ○ | X |
| Total estimation | X | ○ | ◎ | ◎ | ◎ | ○ | X |

TABLE 6

| | Package maintaining temperature (° C.) | Maintaining period before false-twist texturing (weeks) | Difference in winding diameter of package (mm) | Difference in dry heat shrinkage stress value (cN/dtex) | Yarn fineness variation value U % (%) | Yarn fineness variation coefficient | Draw false-twisting ability | Dyeing appearance quality of false-twist textured yarn | Total estimation |
|---|---|---|---|---|---|---|---|---|---|
| Example 22 | 10 | 1 | 2 | 0.003 | 0.9 | 0.2 | ◎ | ◎ | ◎ |
| Example 23 | 10 | 2 | 2 | 0.003 | 0.9 | 0.2 | ◎ | ◎ | ◎ |
| Example 24 | 10 | 4 | 2 | 0.003 | 0.9 | 0.2 | ◎ | ◎ | ◎ |
| Example 25 | 20 | 1 | 3 | 0.004 | 0.9 | 0.2 | ◎ | ◎ | ◎ |
| Example 26 | 20 | 2 | 4 | 0.005 | 1.0 | 0.3 | ◎ | ◎ | ◎ |
| Example 27 | 20 | 4 | 5 | 0.005 | 1.0 | 0.3 | ◎ | ◎ | ◎ |
| Example 28 | 25 | 1 | 4 | 0.005 | 0.9 | 0.3 | ◎ | ◎ | ◎ |
| Example 29 | 25 | 2 | 5 | 0.005 | 1.1 | 0.3 | ◎ | ◎ | ◎ |
| Example 30 | 25 | 4 | 7 | 0.007 | 1.3 | 0.4 | ○ | ○ | ○ |
| Comparative example 7 | 35 | 1 | −13 | 0.017 | 3.2 | more than 1.0 | X | X | X |
| Comparative example 8 | 35 | 2 | −21 | 0.019 | 4.1 | more than 1.0 | impossible to be false-twisted | — | X |
| Comparative example 9 | 35 | 4 | −23 | 0.023 | 4.3 | more than 1.0 | impossible to be false-twisted | — | X |

TABLE 7

| | Comparative example 10 | Example 31 | Example 32 | Example 33 | Example 34 | Example 35 | Comparative example 11 |
|---|---|---|---|---|---|---|---|
| Hot godet roll speed (m/min) | 1950 | 2100 | 2400 | 2700 | 3000 | 3300 | 3600 |
| Draw ratio | 1.3 | 1.4 | 1.6 | 1.8 | 2.0 | 2.2 | 2.4 |
| Drawing tension (cN/dtex) | 0.02 | 0.05 | 0.10 | 0.18 | 0.28 | 0.39 | 0.48 |
| Winding speed (m/min) | 1794 | 1932 | 2208 | 2484 | 2760 | 3036 | 3312 |
| $Vw/V_R$ | 0.92 | 0.92 | 0.92 | 0.92 | 0.92 | 0.92 | 0.92 |
| Spinning stability | X | ◎ | ◎ | ◎ | ◎ | ○ | X |
| Difference in winding diameter (mm) | 3 | 3 | 3 | 4 | 5 | 9 | 15 |
| Difference in dry heat shrinkage stress value (cN/dtex) | 0.02 | 0.01 | 0.01 | 0.01 | 0.01 | 0.02 | 0.08 |
| Yarn fineness variation value U % (%) | 1.8 | 1.4 | 1.1 | 0.9 | 1.0 | 1.4 | 1.6 |
| Yarn fineness variation coefficient | 0.6 | 0.4 | 0.2 | 0.2 | 0.2 | 0.4 | 0.6 |
| Difference in unwinding tension ΔF (cN/dtex) | 0.002 | 0.003 | 0.004 | 0.005 | 0.006 | 0.008 | 0.011 |
| Bulging percentage (%) | 7 | 7 | 8 | 8 | 9 | 10 | 14 |
| Stretching elongation of selvage fiber Vc (%) | 0 | 0 | 0 | 1 | 2 | 3 | 6 |
| Selvage hardness | 72 | 74 | 78 | 78 | 84 | 88 | 93 |
| Difference in hardness between opposite selvages | 1 | 2 | 4 | 4 | 5 | 8 | 11 |
| Stretching elongation $CE_2$ (%) | 2 | 9 | 12 | 13 | 14 | 19 | 18 |
| Elongation at break (%) | 85 | 68 | 58 | 47 | 37 | 30 | 24 |
| Dry heat shrinkage stress value (cN/dtex) | 0.01 | 0.03 | 0.04 | 0.05 | 0.10 | 0.14 | 0.22 |
| Unwinding property | ◎ | ◎ | ◎ | ◎ | ◎ | ○ | X |
| False-twisting ability | ○ | ◎ | ◎ | ◎ | ◎ | ○ | ○ |
| Dyeing appearance quality | X | ○ | ◎ | ◎ | ◎ | ◎ | X |
| Total estimation | X | ○ | ◎ | ◎ | ◎ | ○ | X |

TABLE 8

| | Example 36 | Example 37 | Example 38 | Example 39 | Example 40 | Example 41 | Comparative example 12 |
|---|---|---|---|---|---|---|---|
| Speed ratio of No.3 GD/No.2 GD | 1.00 | 1.00 | 1.00 | 1.00 | 1.05 | 1.10 | 0.98 |
| No.3 GD temperature (° C.) | non-heated | 90 | 120 | 150 | 110 | 110 | non-heated |
| $VW/V_R$ | 0.96 | 0.96 | 0.93 | 0.92 | 0.92 | 0.86 | 0.83 |
| Winding speed Vw (m/min) | 2920 | 2910 | 2850 | 2820 | 2820 | 2537 | 2530 |
| Spinning stability | ◎ | ◎ | ◎ | ◎ | ◎ | ○ | ○~X |
| Difference in winding diameter (mm) | 7 | 5 | 4 | 3 | 3 | 3 | 7 |
| Difference in dry heat shrinkage stress value (cN/dtex) | 0.01 | 0.006 | 0.005 | 0.01 | 0.01 | 0.01 | 0.004 |
| Yarn fineness variation value U % (%) | 1.2 | 1.1 | 1.1 | 1.0 | 1.0 | 1.2 | 1.2 |
| Yarn fineness variation coefficient | 0.3 | 0.2 | 0.2 | 0.2 | 0.2 | 0.2 | 0.4 |
| Difference in unwinding tension ΔF (cN/dtex) | 0.005 | 0.005 | 0.004 | 0.004 | 0.005 | 0.004 | 0.003 |
| Bulging percentage (%) | 9 | 8 | 8 | 7 | 8 | 10 | 6 |

TABLE 8-continued

| | Example 36 | Example 37 | Example 38 | Example 39 | Example 40 | Example 41 | Comparative example 12 |
|---|---|---|---|---|---|---|---|
| Stretching elongation of selvage fiber Vc (%) | 2 | 2 | 3 | 3 | 2 | 1 | 0 |
| Selvage hardness | 82 | 83 | 82 | 80 | 81 | 80 | 74 |
| Difference in hardness between opposite selvages | 2 | 3 | 2 | 2 | 3 | 4 | 4 |
| Stretching elongation $CE_2$ (%) | 17 | 29 | 25 | 22 | 20 | 20 | 4 |
| Elongation at break (%) | 36 | 36 | 37 | 37 | 36 | 35 | 39 |
| Dry heat shrinkage stress value (cN/dtex) | 0.13 | 0.15 | 0.14 | 0.11 | 0.12 | 0.11 | 0.09 |
| Unwinding property | ◎ | ◎ | ◎ | ◎ | ◎ | ◎ | ○~X |
| Dyeing appearance quality | ◎ | ◎ | ◎ | ◎ | ◎ | ◎ | ○ |
| Total estimation | ◎ | ◎ | ◎ | ◎ | ◎ | ○ | ○~X |

Note
GD; godet roll

TABLE 9

| | Winding width of package (mm) | Winding diameter of package (mm) | Winding weight of package (kg) | Difference in winding diameter (mm) | Bulging percentage (%) | Difference in unwinding tension ΔF (cN/dtex) | Unwinding property | Dyeing appearance quality | Total estimation |
|---|---|---|---|---|---|---|---|---|---|
| Comparative example 13 | 50 | 300 | 2.4 | 13 | 18 | 0.010 | X | X | X |
| Example 42 | 85 | 300 | 4.4 | 6 | 8 | 0.004 | ◎ | ◎ | ◎ |
| Example 43 | 110 | 300 | 5.8 | 4 | 7 | 0.005 | ◎ | ◎ | ◎ |
| Example 44 | 190 | 300 | 10.2 | 4 | 6 | 0.006 | ◎ | ◎ | ◎ |
| Comparative example 14 | 300 | 200 | 6.8 | 3 | 5 | 0.010 | X | X | X |

TABLE 10

| Unwinding speed u (m/min) | 500 | 800 | 1000 | 1300 |
|---|---|---|---|---|
| Package of conjugate fiber in Example 32 (cN/dtex) | 0.001 | 0.002 | 0.004 | 0.006 |

TABLE 10-continued

| | | | | |
|---|---|---|---|---|
| Package of conjugate fiber in Comparative example 14 (cN/dtex) | 0.006 | 0.009 | 0.011 | 0.014 |

TABLE 11

| | Example 45 | Example 46 | Example 47 | Comparative example 15 |
|---|---|---|---|---|
| Intrinsic viscosity of PTT (dl/g) | 1.00 | 1.25 | 1.25 | (PET) 0.75 |
| Other polyester component | PET | PET | PBT | PET |
| Intrinsic viscosity of other polyester component (dl/g) | 0.50 | 0.60 | 1.00 | 0.50 |
| Spinning stability | ◎ | ◎ | ◎ | ◎ |
| Difference in winding diameter (mm) | 4 | 6 | 7 | 8 |
| Difference in dry heat shrinkage stress value (cN/dtex) | 0.04 | 0.03 | 0.01 | 0.06 |
| Yarn fineness variation value U % (%) | 1.1 | 1.0 | 0.9 | 0.9 |

TABLE 11-continued

| | Example 45 | Example 46 | Example 47 | Comparative example 15 |
|---|---|---|---|---|
| Yarn fineness variation coefficient | 0.4 | 0.4 | 0.3 | 0.4 |
| Difference in unwinding tension ΔF (cN/dtex) | 0.007 | 0.008 | 0.004 | 0.007 |
| Bulging percentage (%) | 9 | 10 | 8 | 8 |
| Stretching elongation of selvage fiber Vc (%) | 3 | 4 | 3 | 2 |
| Selvage hardness | 88 | 89 | 84 | 93 |
| Difference in hardness between opposite selvages | 6 | 8 | 5 | 8 |
| Stretching elongation $CE_2$ (%) | 8 | 11 | 20 | 3 |
| Elongation at break (%) | 44 | 42 | 48 | 32 |
| Dry heat shrinkage stress value (cN/dtex) | 0.15 | 0.16 | 0.12 | 0.26 |
| Tensile strength of false-twist textured yarn (cN/dtex) | 3.4 | 3.1 | 2.5 | 3.7 |
| Stretching elongation of false-twist textured yarn $CE_2$ (%) | 65 | 78 | 105 | 35 |
| Unwinding property | ○ | ○ | ◎ | ○ |
| False-twisting ability | ◎ | ◎ | ◎ | ◎ |
| Dyeing appearance quality | ◎ | ◎ | ◎ | ○ |
| Total estimation | ○ | ○ | ◎ | X |

CAPABILITY OF EXPLOITATION IN INDUSTRY

The polyester type conjugate fiber package according to the present invention is capable of being provided to the knitting/weaving process as it is or after being subjected to the draw false-twist texturing process. The resultant fabric is free from the periodic dyeing unevenness to be excellent in appearance quality and stretch-back property. Further, by using the polyester type conjugate fiber package according to the present invention, it is possible to obtain a good quality false-twist textured yarn. Particularly, the present invention is useful for providing a polyester type conjugate fiber package suitable for industrial production.

What is claimed is:

1. A package of polyester type conjugate fiber of either a side-by-side type or an eccentric sheath/core type in which two kinds of polyester components are adhered to each other to form a single filament, wherein at least one of the components consisting of the single filament is polytrimethylene terephthalate containing repeating units of trimethylene terephthalate of 90 mol % or more, which package is formed of 2 kg or more of the conjugate fiber an satisfies the following items (1) to (5):

(1) a ratio of the two kinds of polyester components in the cross section of the single filament is in a range of from 40/60 to 70/30 wherein the denominator is a component having a lower intrinsic viscosity and the numerator is a component having a higher intrinsic viscosity, (2) a difference in intrinsic viscosity between the two kinds of polyester components is in a range from 0.05 to 0.8 dl/g, (3) the difference in diameter between a selvage portion and a central portion of the package is 10 mm or less, (4) a winding width of the package is in a range from 60 to 250 mm and a diameter of the package is in a range from 100 to 400 mm, and (5) the difference in dry-heat shrinkage stress value between the conjugate fibers layered in the selvage portion and the central portion of the package is 0.05 cN/dtex or less.

2. A package of polyester type conjugate fiber a defined by claim 1, wherein the difference in dry-heat shrinkage stress value between the conjugate fibers layered in the selvage portion and the central portion of the package is 0.01 cN/dtex or less.

3. A package of polyester type conjugate fiber a defined by claim 1 or 2, wherein the conjugate fiber layered in the package is a pre-oriented conjugate fiber having an elongation at break in a range from 60 to 120%.

4. A package of polyester type conjugate fiber a defined by claim 1 or 2, wherein the conjugate fiber layered in the package is a drawn conjugate fiber having an elongation at break in a range from 25 to 80%.

5. A package of polyester type conjugate fiber as defined by claim 1 or 2, wherein a yarn fineness variation value U % of the conjugate fiber unwound from the package is 1.5% or less and a variation coefficient of a yarn fineness variation period is 0.4 or less.

6. A package of polyester type conjugate fiber as defined by claim 1 or 2, wherein the relationship between the difference ΔF (cN/dtex) in unwinding tension during the unwinding of the conjugate fiber from the package and an unwinding speed u (m/min) satisfies the following formula (1):

$$\Delta F \leqq 8.0\times10^{-6}u \quad (1)$$

7. A package of polyester type conjugate fiber as defined by claim 1 or 2, wherein a bulge percentage of the package is 12% or less.

8. A package of polyester type conjugate fiber as defined by claim 1 or 2, wherein a stretching elongation Vc of the conjugate fiber layered in the selvage portion of the package is 20% or less prior to being treated with boiling water.

9. A package of polyester type conjugate fiber as defined by claim 1 or 2, wherein a hardness of the selvage portion of the package is in a range from 50 to 90 and the difference in hardness between the opposite selvage portions is 10 or less.

10. A package of polyester type conjugate fiber as defined by claim 1 or 2, wherein a density of the package is in a range from 0.80 to 0.92 g/cm$^3$.

11. A package of polyester type conjugate fiber as defined by claim 1 or 2, wherein both of the two kinds of polyester components are polytrimethylene terephthalate containing 90 mol % or more of the repeating units of trimethylene terephthalate.

* * * * *

UNITED STATES PATENT AND TRADEMARK OFFICE

CERTIFICATE OF CORRECTION

PATENT NO. : 6,824,869 B2
APPLICATION NO. : 10/286894
DATED : November 30, 2004
INVENTOR(S) : Tadashi Koyanagi et al.

It is certified that error appears in the above-identified patent and that said Letters Patent is hereby corrected as shown below:

Claim 1, column 49, line 60, “an satisfies” should read --and satisfies--.

Claim 2, column 50, line 51, “a defined” should read --as defined--.

Signed and Sealed this

Eighth Day of January, 2008

JON W. DUDAS
*Director of the United States Patent and Trademark Office*